US008204409B2

(12) United States Patent
Ikado

(10) Patent No.: US 8,204,409 B2
(45) Date of Patent: Jun. 19, 2012

(54) IMAGE FORMING APPARATUS INCLUDING BOTTLE DRIVING UNIT FOR TONER BOTTLE

(75) Inventor: Masaharu Ikado, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 301 days.

(21) Appl. No.: 12/701,737

(22) Filed: Feb. 8, 2010

(65) Prior Publication Data

US 2010/0209141 A1 Aug. 19, 2010

(30) Foreign Application Priority Data

Feb. 16, 2009 (JP) ..... 2009-033291

(51) Int. Cl.
*G03G 15/08* (2006.01)

(52) U.S. Cl. ..... 399/258; 399/262; 222/DIG. 1

(58) Field of Classification Search ..... 399/258, 399/262; 222/DIG. 1
See application file for complete search history.

(56) References Cited

U.S. PATENT DOCUMENTS

| | | | | |
|---|---|---|---|---|
| 5,734,953 | A | 3/1998 | Tatsumi | |
| 5,852,760 | A * | 12/1998 | Harris et al. | 399/262 |
| 5,907,756 | A * | 5/1999 | Shirota et al. | 399/262 |
| 5,983,059 | A | 11/1999 | Oka et al. | |
| 6,292,644 | B1 | 9/2001 | Goto et al. | |
| 6,785,497 | B1 * | 8/2004 | Hasebe | 399/258 |
| 6,879,789 | B2 * | 4/2005 | Yamada et al. | 399/262 |
| 2005/0196180 | A1 * | 9/2005 | Harumoto | |
| 2006/0008298 | A1 * | 1/2006 | Koyama | 399/258 |

FOREIGN PATENT DOCUMENTS

| | | | |
|---|---|---|---|
| EP | 1 159 874 | A2 | 12/2001 |
| JP | 9-134075 | A | 5/1997 |
| JP | 11-231629 | A | 8/1999 |
| JP | 2000-162861 | A | 6/2000 |
| JP | 3423542 | B2 | 7/2003 |
| JP | 3650678 | B2 | 5/2005 |

* cited by examiner

*Primary Examiner* — David Gray
*Assistant Examiner* — Laura Roth
(74) *Attorney, Agent, or Firm* — Keating & Bennett, LLP

(57) ABSTRACT

In an image forming apparatus, a driving force transmitting member includes a protruding portion that can be removably attached to a concave portion of a toner bottle in a shaft line direction of a rotation shaft. The concave portion and the protruding portion can transmit a rotation driving force of the rotation shaft to the toner bottle by being connected with each other such that the concave portion and the protruding portion cannot be rotated relative to each other. A phase detection member includes a pin inserting hole that can select an attachment phase relative to the rotation shaft and can be fixed such that the phase detection member cannot be rotated relative to the rotation shaft.

12 Claims, 12 Drawing Sheets

IMAGE FORMING APPARATUS INCLUDING BOTTLE DRIVING UNIT FOR TONER BOTTLE

CROSS-REFERENCE TO RELATED APPLICATIONS

This application claims priority under 35 U.S.C. 119 to Japanese Patent Application No. 2009-033291, filed on Feb. 16, 2009, which application is hereby incorporated by reference in its entirety.

BACKGROUND OF THE INVENTION

1. Field of the Invention

The present invention relates to an image forming apparatus and a toner bottle arranged to supply toner to the image forming apparatus. More specifically, the present invention relates to a configuration for ensuring incompatibility between the image forming apparatus and the toner bottle.

2. Description of the Related Art

A conventional image forming apparatus forms an image on paper using toner. When an image forming apparatus of this type has run out of toner, it is common to supply toner by replacing a toner bottle (toner cartridge).

When manufacturing such image forming apparatuses, a manufacturer of the image forming apparatus is at times supplied with a plurality of types of toner and photoconductive drums or the like by a components maker. Upon receiving such supplies, the manufacturer selects an appropriate specific combination of toner and a photoconductive drum from among a plurality of possible combinations of the toner and the photoconductive drums to manufacture the image forming apparatus, and then supplies the image forming apparatus to consumers. More specifically, the manufacturer of the image forming apparatus or the components maker conducts experiments to test development performance or the like of actual combinations of the toner and the photoconductive drum. Then, only the combination of the toner and the photoconductive drum that has been determined to be sufficiently usable as the image forming apparatus can be adopted for products.

Accordingly, if toner on which such a combination testing has not been performed is mistakenly supplied to the image forming apparatus, the image forming apparatus may be adversely affected. Therefore, in order to prevent a toner bottle having a certain specification from being attached to image forming apparatuses of other specifications, a shape of a toner bottle attaching portion of the image forming apparatus and a shape of the toner bottle may be changed with respect to each specification so as to provide incompatibility to the toner bottle.

However, when changing the shape of the toner bottle and the shape of the image forming apparatus with respect to each specification for production, a die is required each time, which thereby can increase a manufacturing cost of the toner bottle and the image forming apparatus.

Considering this point, some toner bottles and image forming apparatuses achieve different specifications by changing an angle (rotation phase) of a component that ensures incompatibility and then attaching such a component to the toner bottle and the image forming apparatus.

In such an image forming apparatus, when attaching a toner cartridge, for example, an operator manually rotates the toner cartridge by 180 degrees so as to drop toner contained therein all at once.

In another known configuration, after a toner bottle is attached, the toner bottle is continuously or intermittently rotated by a motor so as to supply toner from the toner bottle by degrees. However, in the above configuration, the toner bottle cannot be rotated by 180 degrees or more. Therefore, such a configuration cannot be applied to drive and rotate the toner bottle.

SUMMARY OF THE INVENTION

In order to overcome the problems described above, preferred embodiments of the present invention provide an image forming apparatus that ensures incompatibility between a toner bottle and the image forming apparatus at a low cost.

According to a first preferred embodiment of the present invention, an image forming apparatus includes a rotation shaft, a drive transmitting member, a phase detection member, a control unit, a regulation member, and a phase selection portion. The rotation shaft is rotated by a rotation driving unit. The drive transmitting member is attached to the rotation shaft such that the drive transmitting member cannot be rotated relative to the rotation shaft. A toner bottle can be removably attached to the drive transmitting member. Further, the drive transmitting member includes a bottle connection portion that can transmit a rotation driving force of the rotation shaft to the toner bottle by being connected with a connected portion of the toner bottle such that the bottle connection portion cannot be rotated relative to the connected portion. The phase detection member is attached to the rotation shaft such that the phase detection member cannot be rotated relative to the rotation shaft. At least when the toner bottle is attached to or removed from the drive transmitting member, the control unit controls the rotation driving unit such that a rotation phase of the phase detection member stops at a prescribed phase. When the toner bottle is attached to or removed from the drive transmitting member, the regulation member regulates the toner bottle such that a rotation phase of the toner bottle is located at a prescribed phase. The phase selection portion is provided on at least one of the rotation shaft, the phase detection member, and the drive transmitting member. The phase selection portion can be used to select a rotation phase thereof and then can be attached after the selection when the phase detection member or the drive transmitting member is attached to the rotation shaft.

In the above image forming apparatus, the toner bottle preferably includes a bottle main body and a cap member. The cap member can preferably change its rotation phase when being attached to the bottle main body. The connected portion is preferably arranged on the cap member.

In the above image forming apparatus, any one of the bottle connection portion and the connected portion preferably includes a plurality of protrusions protruding in a shaft line direction of the rotation shaft. Another one of the bottle connection portion and the connected portion preferably includes a plurality of concave portions that correspond to the plurality of protrusions.

In the above image forming apparatus, preferably, the bottle connection portion and the connected portion are rotationally asymmetric as viewed from the shaft line direction of the rotation shaft.

In the above image forming apparatus, at least one of the plurality of protrusions preferably includes a shape that is different from shapes of the other protrusions.

In the above image forming apparatus, at least one of the plurality of protrusions includes a distance that is different from distances of the other protrusions relative to the rotation shaft.

The above image forming apparatus preferably includes a developing roller, a toner container arranged to supply toner to the developing roller, and a buffer tank arranged to temporarily accumulate toner between the toner bottle and the toner container.

In the above image forming apparatus, the phase selection portion preferably includes a plurality of holes formed thereon in a circumferential direction. An inserting hole to which a pin is inserted is formed on the rotation shaft. By inserting the pin into a hole selected from the plurality of holes and into the inserting hole, the phase detection member or the drive transmitting member can be attached to the rotation shaft.

The above image forming apparatus further preferably includes a toner supplying unit in which substantially cylindrical bottle containing space is provided. The rotation shaft and the drive transmitting member are arranged inside the bottle containing space. The toner bottle is attached to the drive transmitting member inside the bottle containing space, and includes a positioning protrusion protruding in a circumferential direction. A positioning groove that corresponds to the positioning protrusion is formed on an inner peripheral surface of the toner supplying unit along a direction in which the toner bottle is inserted into the bottle containing space.

In the above image forming apparatus, a circular groove connected to the positioning groove is preferably formed on the inner peripheral surface of the toner supplying unit around the entire circumference in an inner peripheral direction of the toner supplying unit. When the toner bottle is driven and rotated, the positioning protrusion is rotated along the circular groove.

In the above image forming apparatus, the positioning protrusion preferably fits to the circular groove only when the bottle connection portion and the connected portion are connected with each other.

A second preferred embodiment of the present invention provides a toner bottle including a bottle main body and a cap member. The cap member includes a driven portion arranged to receive a rotation driving force around a central axis line of the bottle main body. The cap member can change its rotation phase when being attached to the bottle main body.

In the toner bottle, a spiral protrusion is preferably provided inside the bottle main body, and a toner supply port connected to the inside of the toner bottle is preferably provided on the cap member.

The toner bottle is preferably attached to a toner bottle attaching portion of the image forming apparatus in a direction of the central axis line of the bottle main body. A positioning protrusion protruding in a circumferential direction is provided on an outer peripheral surface of the toner bottle. A positioning groove is formed on the toner bottle attaching portion in the direction in which the toner bottle is attached. The positioning protrusion can be fitted to the positioning groove.

The first preferred embodiment of the present invention provides the following advantages. That is, just by selecting an attachment phase of the phase detection member or of the drive transmitting member relative to the rotation shaft and then attaching such a member, image forming apparatuses of a plurality of specifications each having a different rotation phase of the bottle connection portion when the bottle connection portion is attached to or removed from the connected portion (i.e., when the toner bottle is attached to or removed from the drive transmitting member) can be achieved. Regardless of the specification of the image forming apparatus, the toner bottle is regulated by the regulation member such that a phase of the connected portion is located at a prescribed phase when the bottle connection portion is attached to or removed from the connected portion. Thus, incompatibility that permits only a specific toner bottle to be attached with respect to each specification and that prevents other toner bottles from being attached can be achieved by components (the drive transmitting member, the rotation shaft, and the phase detection member) that are common among each specification. Accordingly, the image forming apparatus that achieves such incompatibility can be provided at a low cost.

Moreover, by changing the attachment phase of the common components (i.e., the cap member and the bottle main body), toner bottles of different specifications can be achieved. Accordingly, by sharing the same components, incompatibility of the toner bottle can be achieved at a low cost.

Further, since a plurality of protrusions are provided, the rotation driving force can be transmitted from the drive transmitting member to the toner bottle more reliably as compared with only one protrusion.

Assuming that the bottle connection portion and the connected portion are rotationally symmetric, the bottle connection portion and the connected portion can be connected with each other a plurality of times in a relative phase of 360 degrees. Accordingly, even if there are N selectable rotation phases ("N" is the number of the rotation phases) when attaching the phase detection member (or the drive transmitting member) to the rotation shaft, the number of achievable specifications may be less than "N". Considering this point, by providing the rotationally asymmetric bottle connection portion and connected portion, in the case where there are N selectable rotation phases when attaching the phase detection member (or the drive transmitting member) to the rotation shaft, N different specifications can be reliably achieved.

Furthermore, just by providing at least one of the plurality of protrusions with a shape that is different from shapes of the other protrusions, in the case where there are N selectable rotation phases when attaching the phase detection member (or the drive transmitting member) to the rotation shaft, the N different specifications can be reliably achieved.

By providing at least one of the plurality of protrusions with a distance that is different from distances of the other protrusions relative to the rotation shaft, in the case where there are N selectable rotation phases when attaching the phase detection member (or the drive transmitting member) to the rotation shaft, the N different specifications can be reliably achieved.

Since a certain amount of toner is accumulated in the buffer tank, even when the toner bottle runs out of toner, it takes a certain period of time until the toner container becomes out of toner. Accordingly, even when the toner bottle becomes empty, the toner bottle can be replaced with a certain degree of time to spare.

By inserting the pin into the hole selected from the plurality of holes and into the inserting hole, the phase detection member or the drive transmitting member can be reliably attached to the rotation shaft. Accordingly, since the plurality of holes also serve as attaching holes, with a simple configuration, the phase detection member or the drive transmitting member can be attached to the rotation shaft such that the rotation phase thereof can be selected relative to the rotation shaft.

Furthermore, with the above simple configuration, the attachment of the toner bottle to the drive transmitting member can be regulated only to the prescribed phase.

At the position where the toner bottle is attached to the drive transmitting member, the toner bottle can go back to the rotatable state in order to supply the toner.

The toner bottle can be rotated only when the bottle connection portion and the connected portion are connected with each other, and the toner bottle can be prevented from being mistakenly rotated when the attachment of the toner bottle is insufficient.

By changing the attachment phase of the common components (the cap member and the bottle main body), the toner bottles of different specifications can be achieved. Accordingly, the toner bottle that achieves incompatibility can be provided at a low cost by sharing the same components.

Since all the toner moves towards the toner supply port when the toner bottle is rotated in one direction, all the toner can be supplied to the toner receiving container when supplying the toner.

When attaching the toner bottle, the toner bottle cannot be rotated around the attachment direction, and thus the toner bottle can be attached at the prescribed phase. Therefore, the toner bottle can be attached while maintaining the attachment phase of the cap member and the bottle main body.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
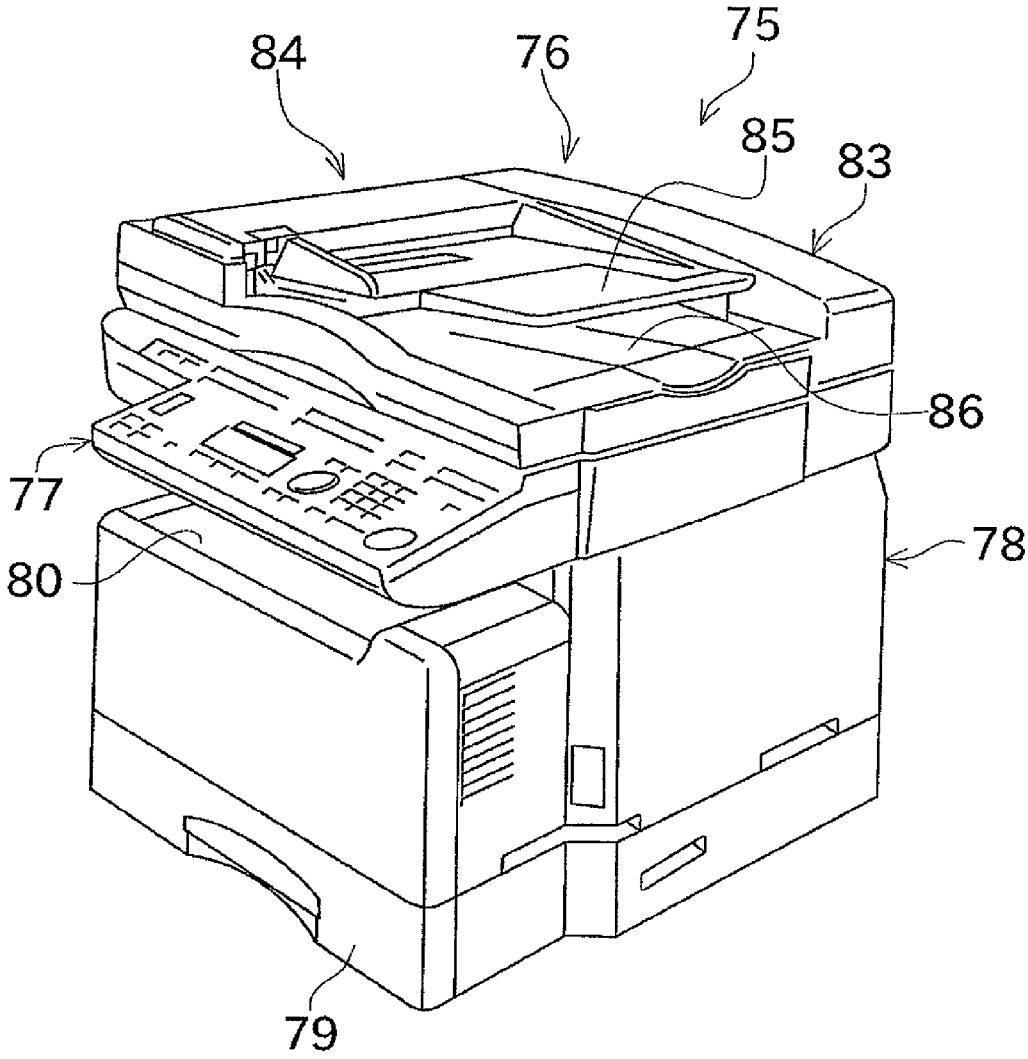
FIG. 1 is an external perspective view of a copier-and-facsimile Multi Functional Peripheral (MFP) according to a preferred embodiment of the present invention.
Figure 2:
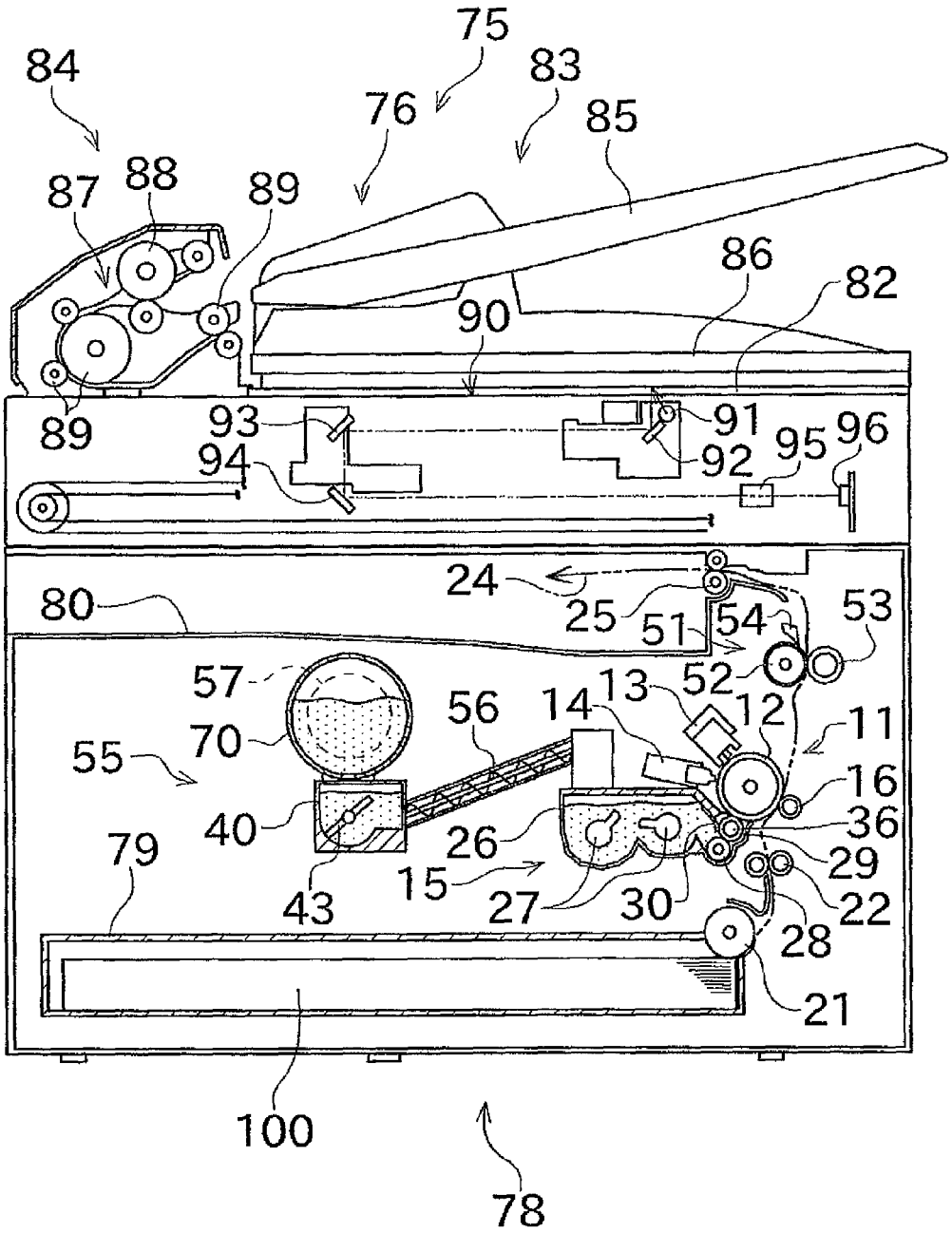
FIG. 2 is a front cross-sectional view illustrating the inside of a main body of the copier-and-facsimile MFP.

Next, preferred embodiments of the present invention will be described. FIG. 1 is an external perspective view of a copier-and-facsimile MFP 75 defined as an image forming apparatus according to a preferred embodiment of the present invention. FIG. 2 is a front cross-sectional view illustrating the inside of a main body of the MFP 75.

The copier-and-facsimile MFP 75 of FIG. 1 preferably includes an image scanning unit 76, an operation panel 77, a main body 78, and a paper feeding cassette 79.

The image scanning unit 76 preferably functions as a flatbed scanner and an automatic document feeding scanner. The operation panel 77 is provided for a user to give instructions to the MFP 75 regarding the number of copies and a facsimile transmission destination or the like.

The main body 78 preferably includes an image forming unit or the like that forms an image on paper provided as a recording medium. The main body 78 preferably includes a not-illustrated transmission and reception unit, etc., for transmitting image data via a communication line. The paper feeding cassette 79 is arranged to sequentially supply the paper to the image forming unit.

FIG. 2 illustrates the inside of the copier-and-facsimile MFP 75. As illustrated in FIG. 2, a platen glass 82, on which original documents to be scanned are placed, is arranged on an upper surface of the main body 78. An original document table cover 83 is arranged above the main body 78. The original document can be pressed against and fixed on the platen glass 82 by the original document table cover 83.

An Automatic Document Feeder (ADF) 84 is provided to the original document table cover 83. The ADF 84 preferably includes an original document tray 85 arranged on an upper portion of the original document table cover 83 and a discharge tray 86 arranged below the original document tray 85.

As illustrated in FIG. 2, an original document transportation path 87 in curved shape is arranged inside the original document table cover 83 to connect the original document tray 85 and the discharge tray 86. The original document transportation path 87 preferably includes a separation roller 88 and a plurality of transportation rollers 89. With this configuration, the original documents stacked on the original document tray 85 are separated one sheet at a time, transported along the curved original document transportation path 87, and after passing through an original document scanning position, the original document is discharged onto the discharge tray 86.

As illustrated in FIG. 2, a scanner unit 90 is preferably arranged on an upper portion of the main body 78. The scanner unit 90 preferably includes a light source 91, reflection mirrors 92, 93, 94, a condenser lens 95, and Charge Coupled Devices (CCD) 96.

The light source 91 irradiates the platen glass 82 or the original document scanning position of the ADF 84 with light. Light reflected from the original document is further reflected by the reflection mirrors 92, 93, 94, converged by the condenser lens 95, and formed into an image at a portion of the CCD 96. The CCD 96 converts the convergent light into an electric signal and outputs the signal.

The light source 91 and the reflections mirrors 92, 93, 94 or the like of the scanner unit 90 can be appropriately moved. Accordingly, when using the MFP 75 as the flatbed scanner, the light source 91 and the reflection mirrors 92, 93, 94 or the like are moved at a constant speed so as to scan the original document placed on the platen glass 82. When using the MFP 75 as the ADF scanner, the light source 91 and the reflection mirrors 92, 93, 94 or the like are moved to and stopped at the original document scanning position of the ADF 84 so as to scan the original document being transported through the original document transportation path 87.

As described above, the reflected light from the original document is introduced into the CCD 96 and formed into an image. The CCD 96 outputs the electric signal based on the original document. After an appropriate conversion process, the electric signal is transmitted to a later-described image forming unit 11 or to another facsimile machine by the transmission and reception unit via the communication line.

As illustrated in FIG. 2, the paper feeding cassette 79 for supplying paper 100 is arranged at a lower portion of the main body 78. The paper feeding cassette 79 can be drawn at a front side of the machine (i.e., at a front side of FIG. 2). The image forming unit 11, a fusing device 51, and a discharge tray 80 are provided above the paper feeding cassette 79.

A transportation path 24 arranged to transport the paper 100 from the paper feeding cassette 79 to the discharge tray 80 is provided inside the main body 78. After extending upward from one end side of the paper feeding cassette 79, the transportation path 24 reaches the image forming unit 11 while partially curving. Then, after passing through the fusing device 51 arranged further above, the transportation path 24 curves in a horizontal direction to reach the discharge tray 80.

A paper feeding roller 21 is arranged above the paper feeding cassette 79 and arranged to make contact with the uppermost paper 100 stacked in the paper feeding cassette 79. In this state, when the paper feeding roller 21 is driven, the uppermost paper 100 is separated by the paper feeding roller 21 and a not-illustrated separation pad, and fed to the transportation path 24.

A transportation roller 22 is arranged immediately downstream of the paper feeding roller 21 in the transportation path 24. The transportation roller 22 is driven while nipping the paper 100 with a roller arranged to face the transportation roller 22, and thus transports the paper 100 to the image forming unit 11 arranged downstream.

As illustrated in FIG. 2, the image forming unit 11 preferably includes a charger 13, a Light Emitting Diode (LED) head 14, a developing unit 15, and a transfer roller 16, which are arranged around a photoconductive drum 12. The image forming unit 11 also preferably includes a toner supplying unit 55 arranged to supply toner to the developing unit 15.

A photoconductive layer preferably made of an organic photoreceptor is provided on a front surface of the photoconductive drum 12. The photoconductive drum 12 is rotatably driven by a not-illustrated electric motor. The charger 13 preferably uses a contactless corona charging method, and the front surface of the photoconductive drum 12 is uniformly and, for example, negatively charged by the charger 13.

The LED head 14, which defines an exposure unit, is arranged downstream (which refers to a downstream side in a rotation direction of the photoconductive drum 12, and the same can be said for the developing unit 15 and the transfer roller 16) of the charger 13, and includes a plurality of Light Emitting Diodes aligned in a paper width direction. The LED head 14 selectively emits light in accordance with image data of a facsimile original document received through a telephone line or with image data scanned by the image scanning unit 76. As a result, the front surface of the photoconductive drum 12 is selectively exposed, charge energy on an exposed portion is lost, and thus an electrostatic latent image is formed.

The developing unit 15 is arranged downstream of the LED head 14. The developing unit 15 preferably uses a two-component developing method using toner (pigment powder) and carrier (magnetic powder) as developer. The developing unit 15 preferably includes a developer container (toner container) 26 that contains the developer and agitation blades 27 that are driven and rotated inside the developer container 26 to agitate the developer. Further, the developing unit 15 preferably includes an agitation paddle 28 inside the developer container 26, a developing roller 29 arranged close to the photoconductive drum 12 with a slight space therebetween, and a regulation blade 30 arranged in contact with an outer peripheral surface of the developing roller 29.

The agitation blades 27 are driven and rotated, and thus circulate the two-component developer in the developer container 26. The agitation paddle 28 is also driven and rotated, and the toner and the carrier are adsorbed to each other by static electricity generated by frictional electrification between the toner and the carrier.

The developing roller 29 is preferably made of non-magnetic material and formed in a tubular shape. The developing roller 29 is rotatably fitted to an external side of a cylindrical magnetic body 36. The inner magnetic body 36 uses its magnetic force to adsorb the carrier to a front surface of the developing roller 29. By rotating the developing roller 29 in this state, the toner and the carrier are transferred to the photoconductive drum 12 while being held on the front surface of the developing roller 29. The toner on the front surface of the developing roller 29 is adjusted by the regulation blade 30 in such a manner that adhesion thickness thereof will be even.

Then, at a portion where the photoconductive drum 12 and the developing roller 29 are located close to each other, the toner on the front surface of the developing roller 29 is selectively transferred to the front surface of the photoconductive drum 12, more specifically, only to a portion of the photoconductive drum 12 exposed by the LED head 14. As a result, a toner image is formed on the front surface of the photoconductive drum 12. From the developer, the carrier and the remaining toner which has not been transferred to the photoconductive drum 12 are collected in the developer container 26.

The transfer roller 16 is arranged downstream of the developing unit 15 and on an opposite side of the photoconductive drum 12 across the transportation path 24. A prescribed voltage is applied to the transfer roller 16 by a power source. Accordingly, the toner image formed on the front surface of the photoconductive drum 12 is moved close to the transfer roller 16 by the rotation of the photoconductive drum 12, and then transferred to the paper 100 by the electric attraction of the transfer roller 16. The paper 100 having the toner image transferred thereon is fed by the rotation of the photoconductive drum 12 to the fusing device 51 arranged on a downstream side of the transportation path 24.

The toner supplying unit 55 preferably includes a buffer tank 40 and a bottle driving unit 57. A replaceable cartridge-type toner bottle 70 can be attached to the bottle driving unit 57.

The toner bottle 70 is a cylindrical container filled with toner therein. As described above, the toner bottle 70 can be replaced, and when an old toner bottle 70 runs out of toner, such an old toner bottle 70 is replaced with a new toner bottle 70 so as to supply toner to the copier-and-facsimile MFP 75. Moreover, when toner concentration of the developer container 26 decreases, the toner bottle 70 is appropriately rotated by the bottle driving unit 57, and thus drops and supplies the toner by degrees to the buffer tank 40. In other words, because the toner can be supplied while toner discharge rate (amount) is accurately controlled by controlling the rotation of the toner bottle 70, the toner concentration of the developer container 26 can be maintained substantially constant.

The buffer tank 40 is arranged below the toner bottle 70 and serves as a container that is open at an upper portion. The buffer tank 40 can temporarily accumulate the toner dropped from the toner bottle 70. Thus, even when the toner bottle 70 runs out of toner, a certain amount of toner can be supplied to the developer container 26 until the buffer tank 40 becomes empty (i.e., until the buffer tank 40 runs out of toner). Therefore, the toner bottle 70 can be replaced with enough time to spare.

An agitation blade 43 arranged in the buffer tank 40 is rotated to agitate the toner inside the buffer tank 40. A screw transportation device 56 is connected to the buffer tank 40, and the agitation blade 43 also guides the toner of the buffer tank 40 to a portion where the screw transportation device 56 is connected. The screw transportation device 56 connects the buffer tank 40 and the developer container 26, and transports the toner from the buffer tank 40 to the developer container 26 by rotating a screw therein. With this configuration, the toner in the toner bottle 70 can be supplied to the developer container 26 via the buffer tank 40 and the screw transportation device 56.

The fusing device 51 preferably includes a heat roller 52 arranged to be driven and rotated and a press roller 53 facing the heat roller 52. The press roller 53 is pressed against the heat roller 52 by a biasing spring. The heat roller 52 includes a heating element such as, for example, a halogen lamp, and a front surface of the heat roller 52 can be uniformly heated by energizing (i.e., applying current to) the heating element.

With this configuration, when the paper 100 passes between the heat roller 52 and the press roller 53, the toner of the toner image is melted and fused on the paper 100 by the heat of the highly-heated heat roller 52 and the pressure of the press roller 53. The fusing device 51 preferably includes a separation nail 54 arranged to prevent the paper 100 from being adhered to and wound around the heat roller 52.

As illustrated in FIG. 2, a discharge roller 25 is arranged downstream of the fusing device 51. With this configuration, the paper 100 fed from the fusing device 51 is nipped by the discharge roller 25 and a driven roller facing the discharge roller 25, and then discharged onto the discharge tray 80.

Figure 3:
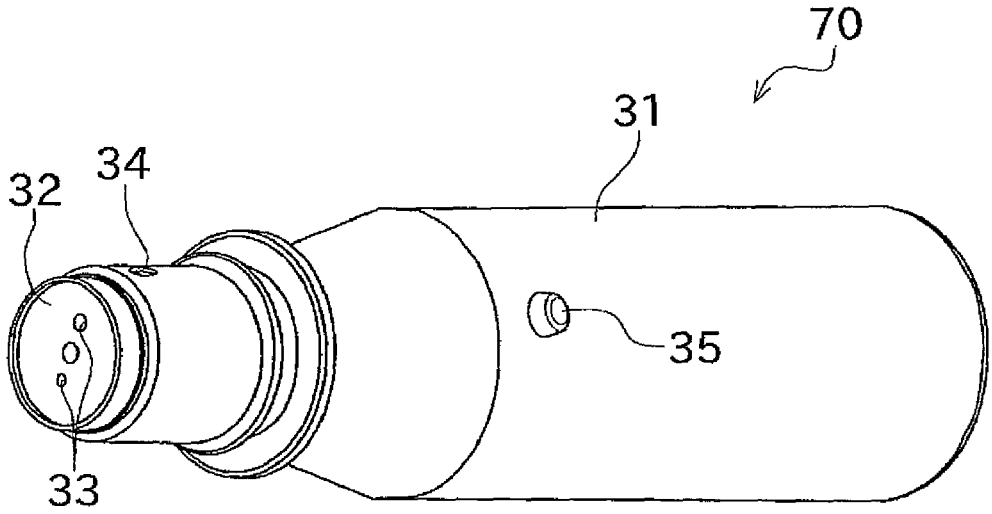
FIG. 3 is an external perspective view of a toner bottle.

Next, with reference to FIG. 3, a configuration of the toner bottle 70 will be described. FIG. 3 is an external perspective view of the toner bottle 70.

The toner bottle 70 preferably includes a bottle main body 31 provided as a substantially cylindrical container that is elongated in an axial direction. A round-shaped cap member 32 is attached to one end side of the bottle main body 31.

The cap member 32 is fixed to the bottle main body 31 by an appropriate method such as adhesion or bonding in such a manner that the cap member 32 cannot rotate relative to the bottle main body 31. The cap member 32 has a concave portion (connected portion or driven portion) 33 that can be engaged with a protruding portion 65 of a later-described driving force transmitting member 61. In the following description of the toner bottle 70, an end portion on a side where the cap member 32 is arranged will be referred to as a tip end portion, and an end portion on the opposite side will be referred to as a rear end portion.

A penetrating toner supply port 34 is provided in the vicinity of the tip end portion of the toner bottle 70, and the inside of the toner bottle 70 is connected to the outside via the toner supply port 34. With this configuration, by rotating the toner bottle 70 by 360 degrees around a central axis of the cylindrical toner bottle 70, a small amount of the toner of the toner bottle 70 drops towards the buffer tank 40 only when the toner supply port 34 faces downward. Accordingly, by rotating the toner bottle 70 several times at a prescribed speed, a small amount of the toner can be intermittently supplied to the buffer tank 40.

In order to appropriately feed the toner of the toner bottle 70 from the toner supply port 34 provided on the side of the tip end portion to the outside, the toner on the side of the rear end portion needs to be sequentially fed to the side of the tip end portion (i.e., to the side of the toner supply port 34). Therefore, in the present preferred embodiment, a not-illustrated spiral protrusion is provided inside the bottle main body 31, and the toner is fed towards the toner supply port 34 by the spiral protrusion by rotating the toner bottle 70 in one direction. However, the toner bottle 70 is not limited to the above configuration, and, for example, the toner bottle 70 may be attached by slanting the entire toner bottle 70 such that the tip end portion is located on a lower side.

For example, the toner supply port 34 is sealed before use of the toner bottle 70 so that the toner does not leak to the outside. When attaching the toner bottle 70 to the toner supplying unit 55, an operator removes the seal and attaches the toner bottle 70 to the bottle driving unit 57 with the toner supply port 34 facing upward (i.e., such that the toner does not leak).

Figure 4:
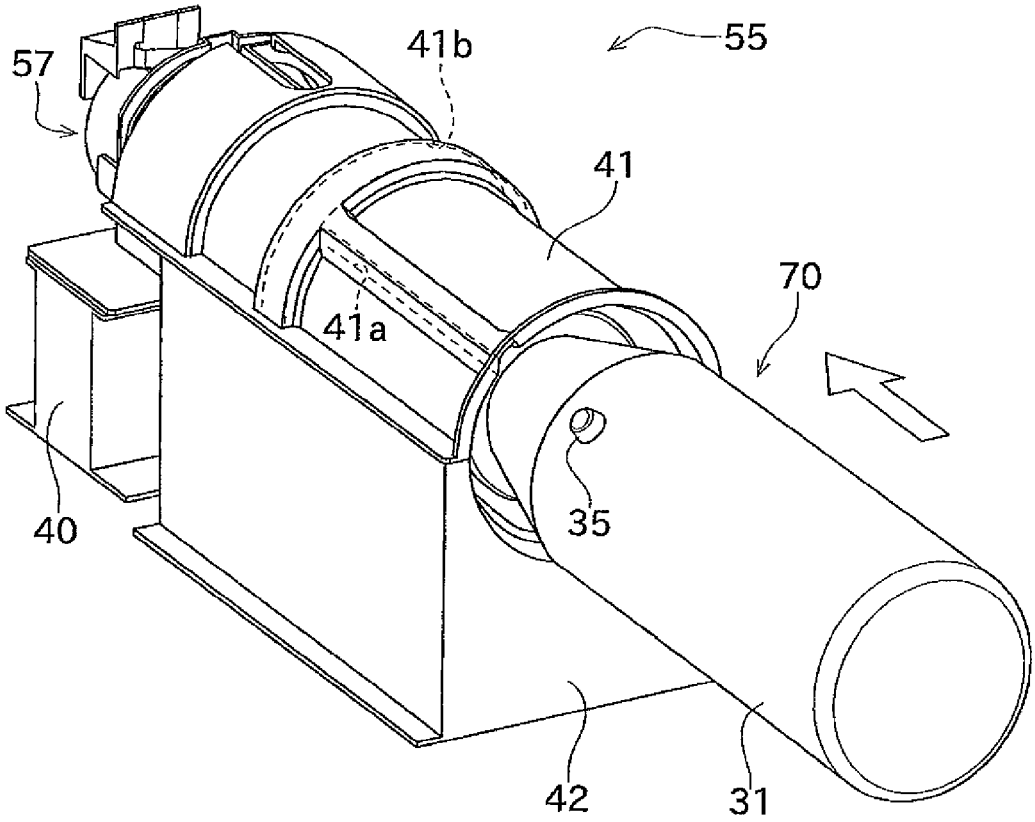
FIG. 4 is an external perspective view illustrating a state in which the toner bottle is being attached to a toner supplying unit.
Figure 5:
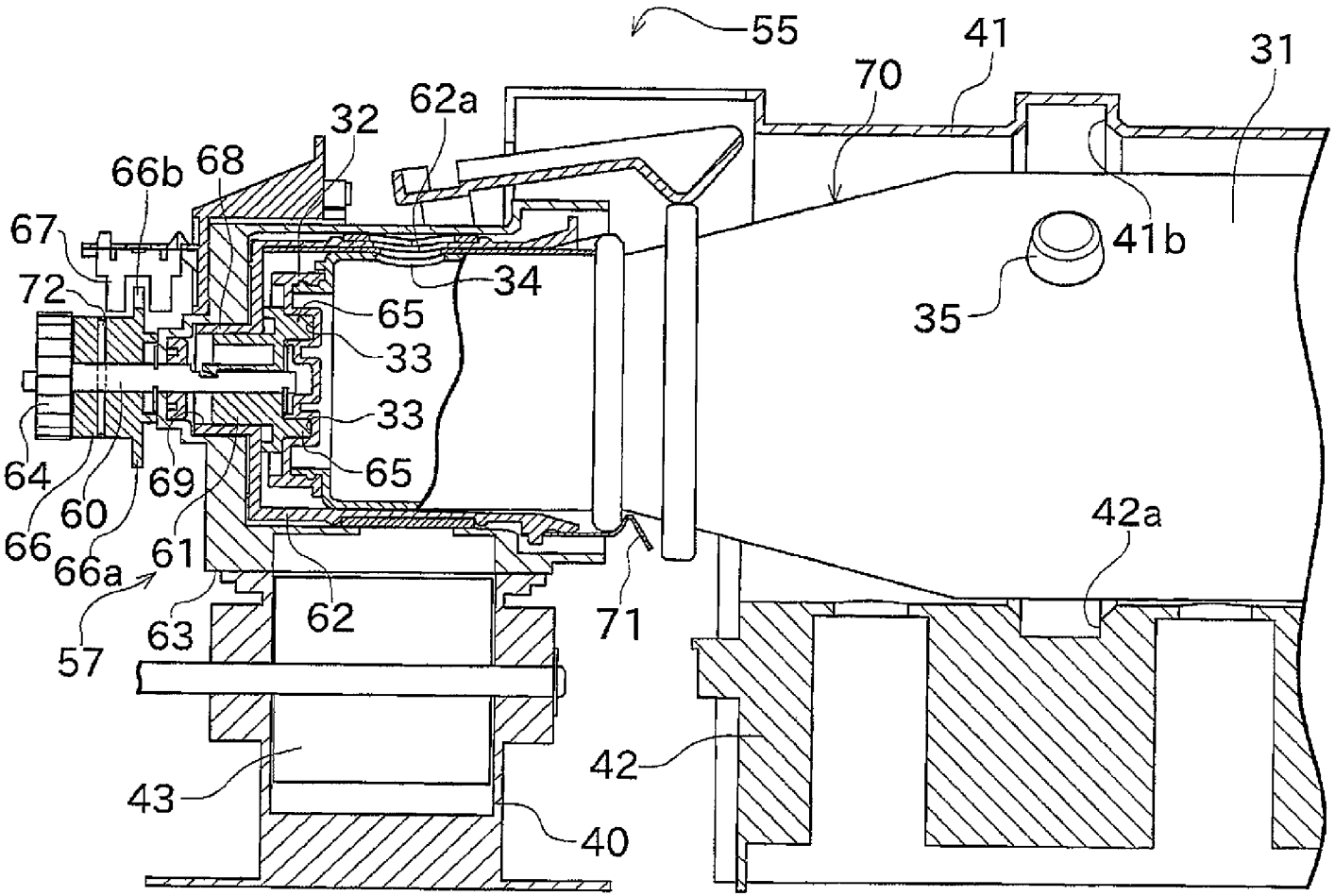
FIG. 5 is a side cross-sectional view illustrating a state in which the toner bottle is attached to a bottle driving unit.

Next, a state in which the toner bottle 70 is attached to the toner supplying unit 55 will be described with reference to FIGS. 4 and 5. FIG. 4 is an external perspective view illustrating a state in which the toner bottle 70 is being attached to the toner supplying unit 55. FIG. 5 is a side cross-sectional view illustrating a state in which the toner bottle 70 is attached to the bottle driving unit 57.

As illustrated in FIG. 4 etc., the toner supplying unit 55 preferably includes a bottle upper surface cover 41 and a bottle lower surface cover 42.

The bottle upper surface cover 41 is a cover member that widely and protectively covers an upper portion of an outer peripheral surface of the toner bottle 70, which is driven and rotated. The bottle upper surface cover 41 includes an inner peripheral surface having an outline formed in a substantially circular shape in cross section along the outer peripheral surface of the toner bottle 70. The bottle lower surface cover 42 makes contact with the outer peripheral surface of the toner bottle 70 at a lower side so as to support the toner bottle 70. The bottle lower surface cover 42 includes an inner peripheral surface having an outline in a substantially circular shape in cross section along the outer peripheral surface of the toner bottle 70.

By combining the bottle upper surface cover 41 and the bottle lower surface cover 42, a substantially cylindrical space (bottle containing space) is provided therein. One end side of the cylindrical bottle containing space is open so that the toner bottle 70 can be inserted from the one end side towards the inside of the bottle containing space. The bottle driving unit 57 is arranged on another end side of the cylindrical bottle containing space. With this configuration, by inserting the toner bottle 70 from the tip end portion towards the bottle containing space, the tip end portion can be guided to the bottle driving unit 57.

As illustrated in FIG. 4, a positioning protrusion 35 protruding in a circumferential direction is provided on the outer peripheral surface of the toner bottle 70. A linear positioning groove 41*a* that is parallel or substantially parallel to a shaft line direction of a rotation shaft 60 (i.e., a linear positioning groove 41*a* arranged in an inserting direction of the toner bottle 70) is provided on the inner peripheral surface of the bottle upper surface cover 41. The positioning groove 41*a* corresponds to the positioning protrusion 35 of the toner bottle 70.

When attaching the toner bottle 70 to the bottle driving unit 57, by adjusting (fitting) the positioning protrusion 35 to the positioning groove 41*a*, the toner bottle 70 is inserted into the cylindrical space defined by the bottle upper surface cover 41 and the bottle lower surface cover 42. When positions of the positioning protrusion 35 and the positioning groove 41*a* are displaced, the positioning protrusion 35 is caught by an edge portion of the bottle upper surface cover 41 or of the bottle lower surface cover 42, and the toner bottle 70 cannot be inserted in the cylindrical space.

When the toner bottle 70 is inserted into the bottle containing space, if the positioning protrusion 35 is still regulated by the positioning groove 41*a*, the toner bottle 70 cannot be driven and rotated by the bottle driving unit 57. Therefore, a semicircular-shaped circular groove 41*b* is provided on the inner peripheral surface of the bottle upper surface cover 41. Also, a semicircular-shaped circular groove 42*a* (refer to FIG. 5) is provided on the inner peripheral surface of the bottle lower surface cover 42.

The two circular grooves 41*b* and 42*a* together define a circular groove by being connected at each end, and an end portion of the positioning groove 41*a* is connected to the circular groove. Therefore, by being moved (fitted) from the positioning groove 41*a* to the circular grooves 41*b* and 42*a*, the positioning protrusion 35 can be moved along the circular grooves 41*b* and 42*a*, and the toner bottle 70 becomes rotatable.

However, positions of the circular grooves 41*b* and 42*a* are set such that the positioning protrusion 35 does not reach the positions of the circular grooves 41*b* and 42*a* unless the toner bottle 70 is inserted sufficiently to the inside. Accordingly, when the insertion of the toner bottle 70 is insufficient (including a state in which the concave portion 33 of the tip end portion of the toner bottle 70 is not appropriately engaged with the later-described protruding portion 65), the toner bottle 70 cannot be rotated.

The positioning groove 41*a* is arranged to correspond to a position of the protruding protrusion 35 when the toner supply port 34 faces upward. Thus, a rotation phase of the toner bottle 70 at the time of attaching the toner bottle 70 to the bottle driving unit 57 can be limited such that the toner supply port 34 faces upward. Accordingly, the bottle upper surface cover 41 can serve as a bottle guiding member (regulation member) that guides the toner bottle 70 by limiting the rotation phase of the toner bottle 70 to a prescribed phase.

As described above, only when the toner supply port 34 faces upward, can the toner bottle 70 be attached to the bottle driving unit 57.

Figure 6:
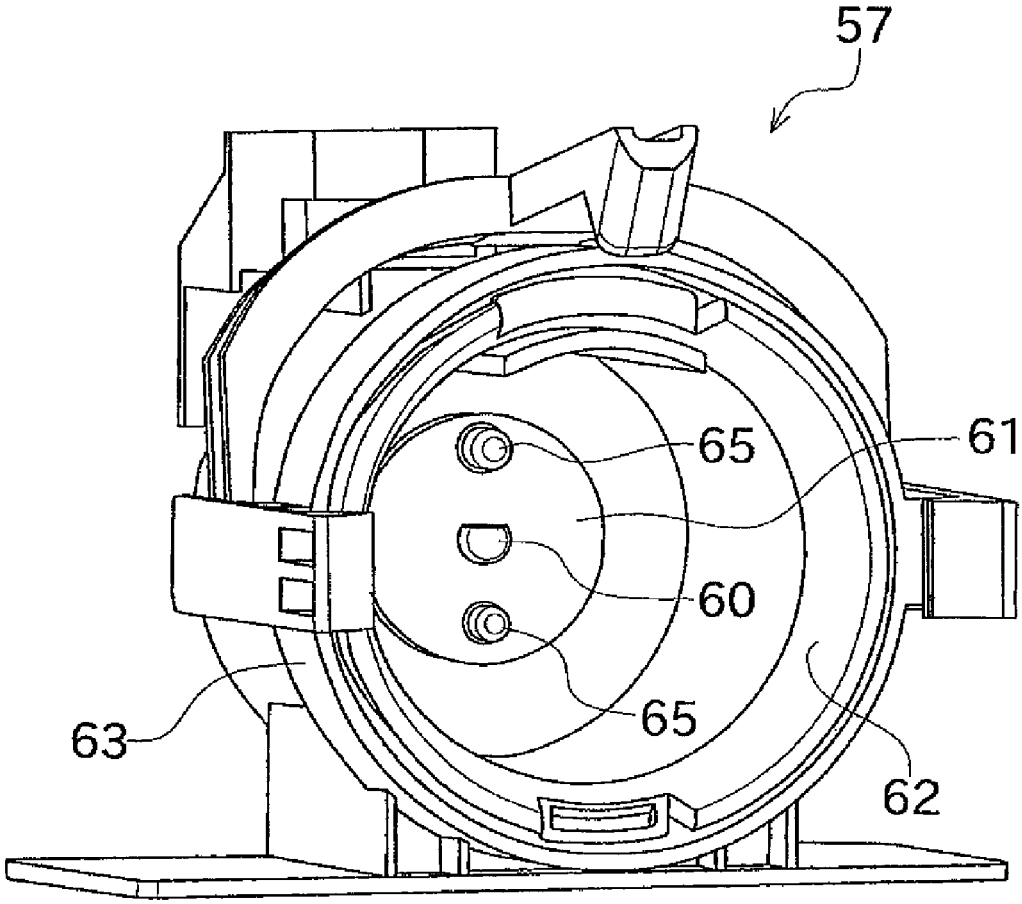
FIG. 6 is an external perspective view of the bottle driving unit.
Figure 7:
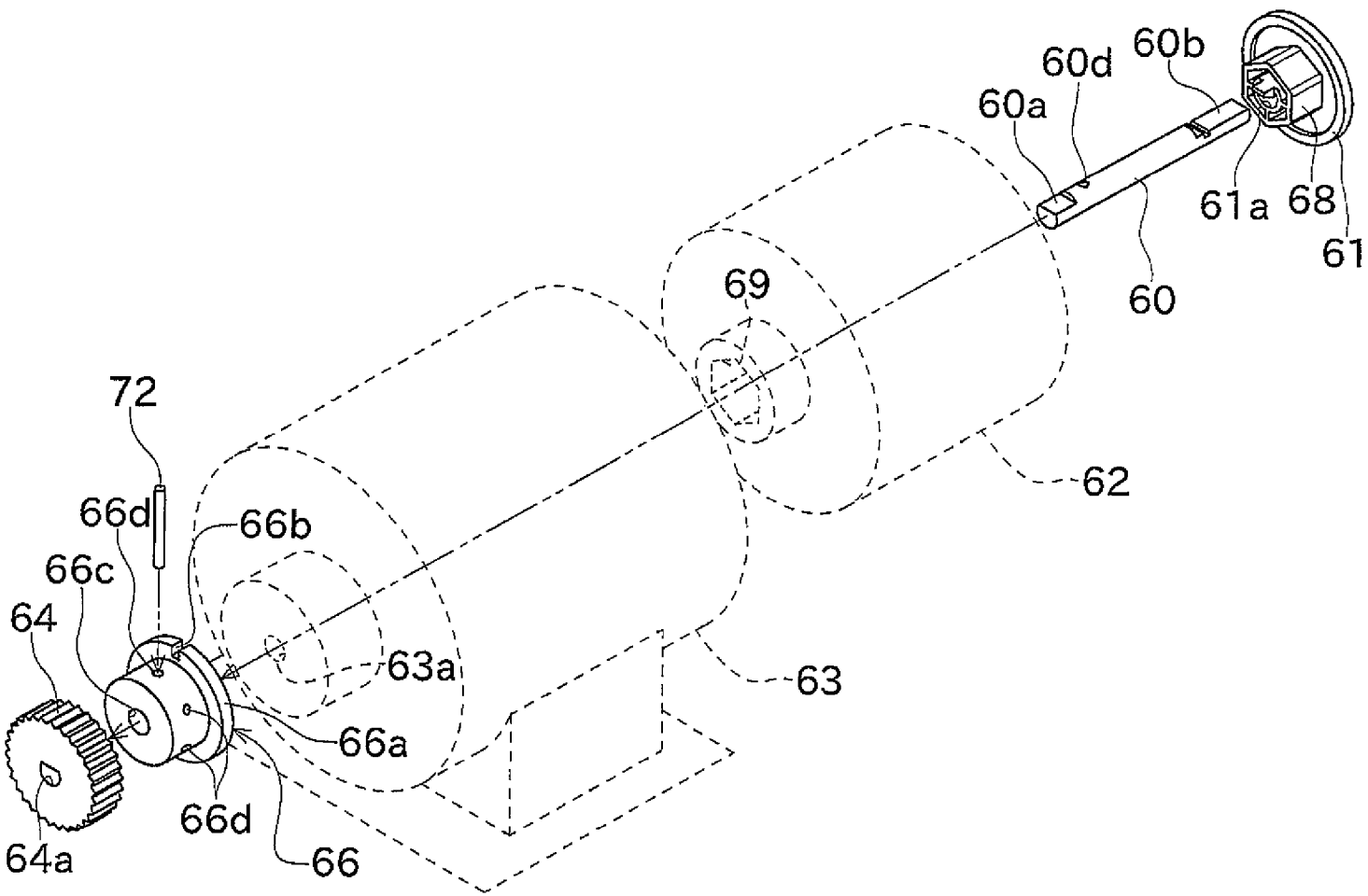
FIG. 7 is a schematic exploded perspective view of the bottle driving unit.

Next, a configuration of the bottle driving unit 57 will be described with reference to FIGS. 5 through 7. FIG. 6 is an external perspective view of the bottle driving unit 57. FIG. 7 is a schematic exploded perspective view of the bottle driving unit 57.

As illustrated in FIGS. 5 and 6, the bottle driving unit 57 preferably includes the rotation shaft 60, the driving force transmitting member (drive transmitting member) 61, a rotation cover (rotation member) 62, and a tip end portion external cover 63.

The rotation shaft 60 has a rod shape. A gear attaching portion 60*a* is provided on one end side of the rotation shaft 60, and a driving force transmitting member attaching portion 60*b* is provided on another end side. As illustrated in FIG. 7, each of the gear attaching portion 60*a* and the driving force transmitting member attaching portion 60*b* preferably has a substantially capital D shape in cross section. A gear 64 is attached to the gear attaching portion 60*a*, and the driving force transmitting member 61 is attached to the driving force transmitting member attaching portion 60*b*.

As illustrated in FIG. 7, a capital D-shaped shaft fixing hole 64*a* is formed on the gear 64. By inserting the gear attaching portion 60*a* of the rotation shaft 60 to the shaft fixing hole 64*a*, the gear 64 is attached such that the gear 64 cannot be rotated relative to the rotation shaft 60. A driving force is input from a not-illustrated motor (rotation driving unit) to the gear 64, and the rotation shaft 60 is driven and rotated by the driving force of the motor via the gear 64. A not-illustrated control unit of the copier-and-facsimile MFP 75 controls an operation of the motor.

The driving force transmitting member 61 is a disc-shaped member, and a shaft fixing hole 61*a* having a capital D shape is formed at the center of the disc member. By inserting the driving force transmitting member attaching portion 60*b* of the rotation shaft 60 into the shaft fixing hole 61*a*, the driving force transmitting member 61 is fixed such that the driving force transmitting member 61 cannot be rotated relative to the rotation shaft 60. With this configuration, the driving force from the motor can be transmitted to the driving force transmitting member 61 via the gear 64 and the rotation shaft 60.

As illustrated in FIGS. 5 and 6, the protruding portion (bottle connection portion) 65 including two cylindrical protrusions protruding in a direction parallel or substantially parallel to the shaft line direction of the rotation shaft 60 is provided on one side of the disc-shaped driving force transmitting member 61. The concave portion 33 provided on the tip end side of the toner bottle 70 has a shape that matches the protruding portion 65 and can be engaged with the protruding portion 65. Accordingly, the driving force transmitting member 61 and the toner bottle 70 are connected such that they cannot be rotated relative to each other, and the toner bottle 70 can be driven and rotated by transmitting the rotation driving force from the motor to the toner bottle 70. The concave portion 33 and the protruding portion 65 can be attached and removed in the shaft line direction of the rotation shaft 60, and thus, the toner bottle 70 can be attached to and removed from the driving force transmitting member 61. With this configuration, the toner bottle 70 can be removed from the bottle driving unit 57 and replaced.

Since the protruding portion 65 includes the two cylindrical protrusions, as compared with one protrusion, for example, the rotation driving force can be transmitted to the toner bottle 70 more stably and reliably.

Figure 8:
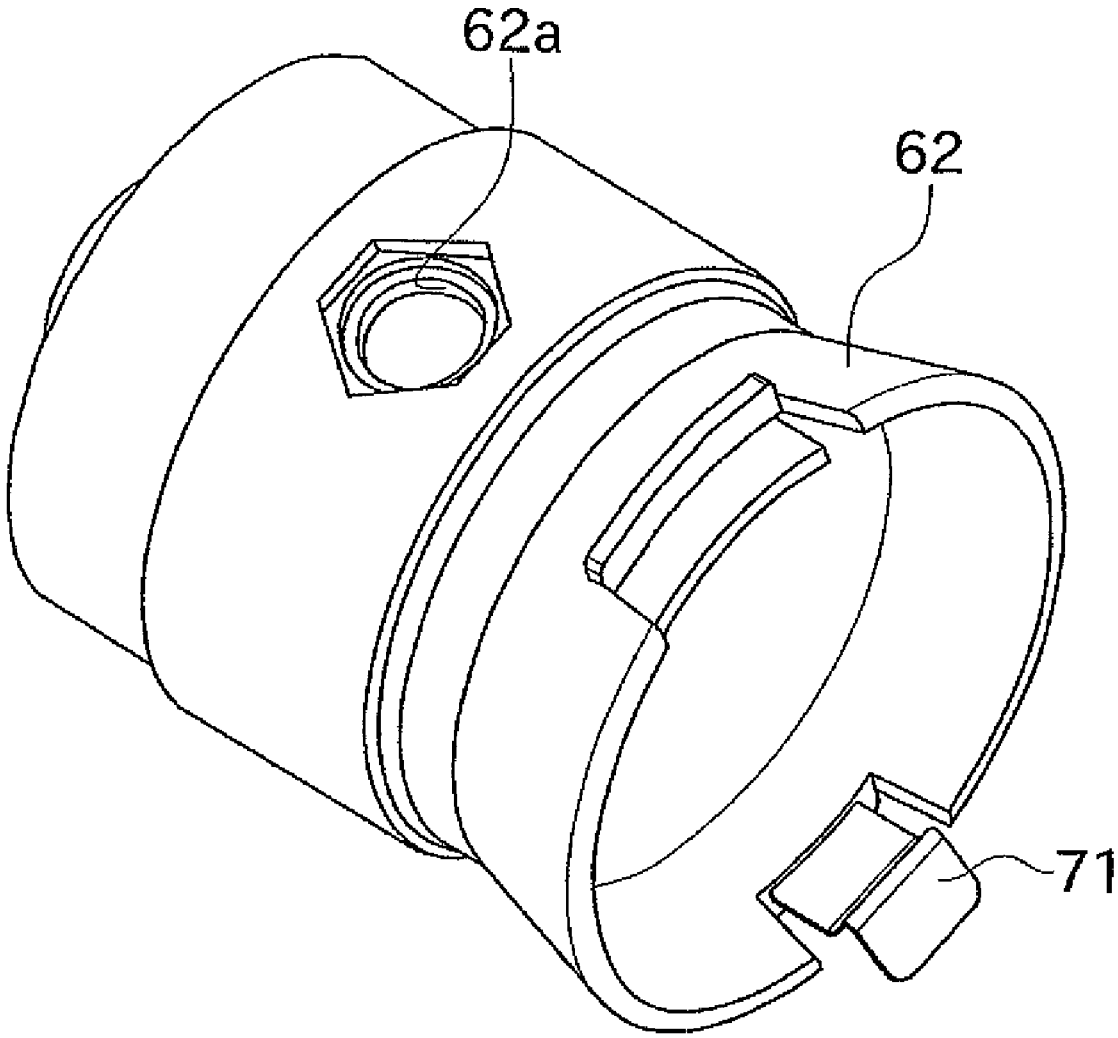
FIG. 8 is an external perspective view of a rotation cover.
Figure 9A:
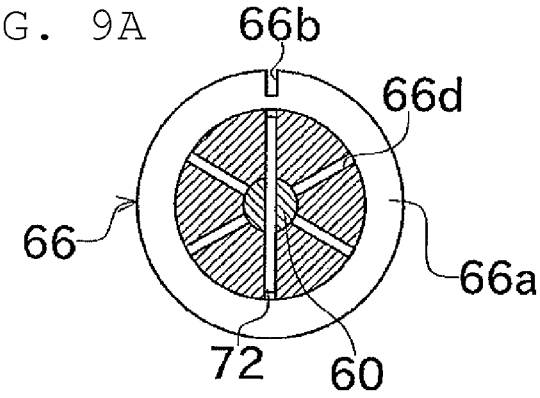
FIGS. 9A-9F illustrate six attachment phases of a phase detection member.
Figure 9D:
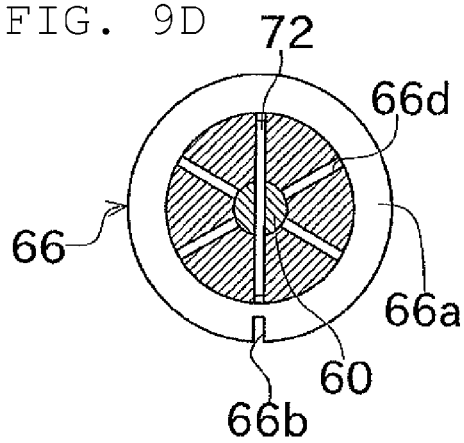
Figure 9B:
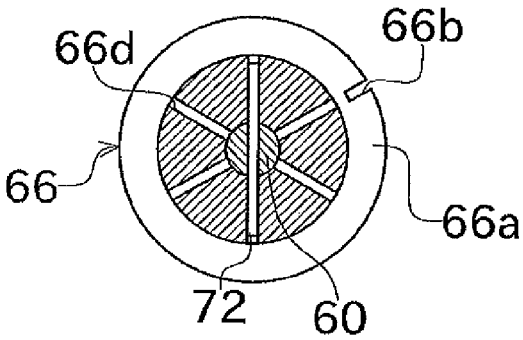
Figure 9E:
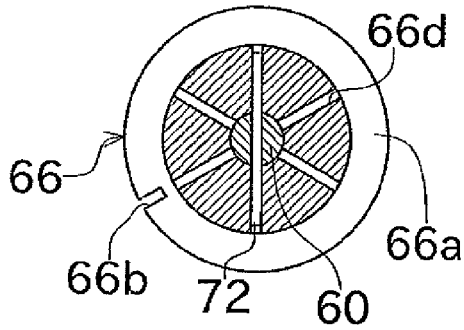
Figure 9C:
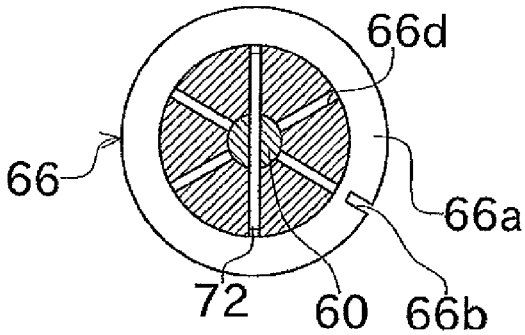
Figure 9F:
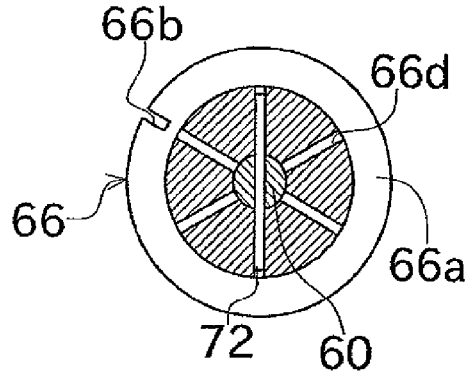
Figure 10A:
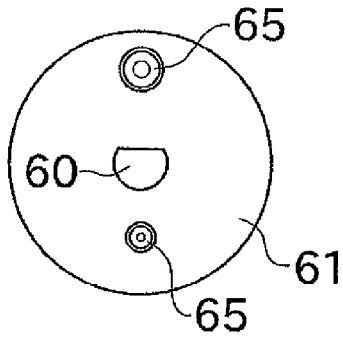
FIGS. 10A-10F illustrate six stop phases of a driving force transmitting member at the time of attaching and removing the toner bottle.
Figure 10D:
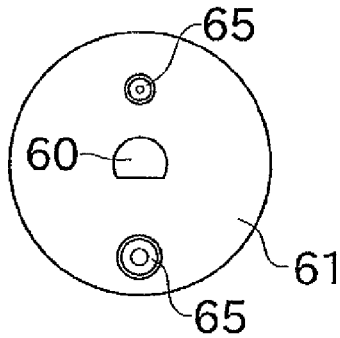
Figure 10B:
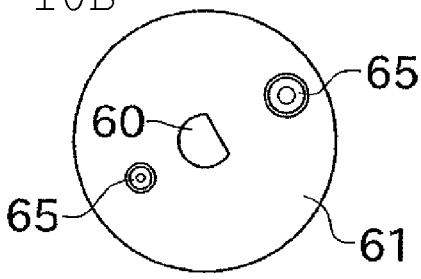
Figure 10E:
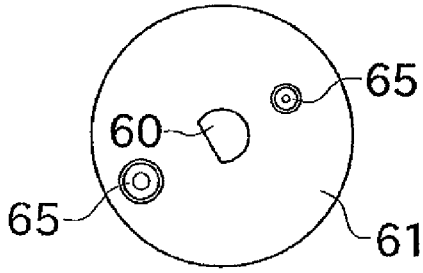
Figure 10C:
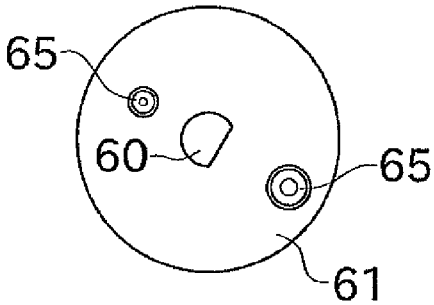
Figure 10F:
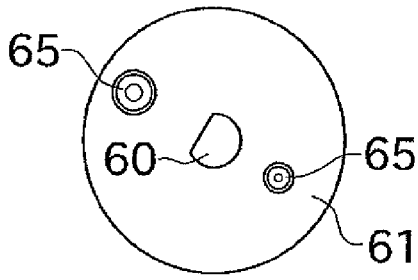

The rotation cover 62 is a cover member that covers the tip end portion of the toner bottle 70 and can be integrally rotated. FIG. 8 is an external perspective view of the rotation cover 62. As illustrated in FIG. 8, the rotation cover 62 is a substantially cup-shaped member having a cylindrical body that is open at one side. The tip end portion of the toner bottle 70 can be inserted into the inside of the cylindrical body such that a central axis line of the cylindrical body matches a central axis line of the toner bottle 70.

As illustrated in FIG. 5, the rotation cover 62 is arranged such that the open end side of the rotation cover 62 is connected to the end portion of the bottle containing space. The central axis (rotation shaft 60) of the rotation cover 62 is arranged to substantially match the central axis of the bottle containing space (cylindrical space). With this configuration, by inserting the toner bottle 70 into the cylindrical space in a direction indicated by an arrow of FIG. 4, the tip end portion of the toner bottle 70 is guided to the rotation cover 62.

As illustrated in FIGS. 5 and 6, the driving force transmitting member 61 is attached such that the driving force transmitting member 61 cannot be rotated relative to the rotation shaft 60 inside the cup-shaped rotation cover 62 (i.e., inside the bottle containing space). Thus, the rotation cover 62 can be driven and rotated around the central axis line of the cylindrical body. The driving force transmitting member 61 is arranged on an inner wall of the rotation cover 62 and attached such that the protruding portion 65 protrudes towards the open side of the rotation cover 62. The protruding portion 65 protrudes in the direction that is parallel or substantially parallel to the central axis line of the cylindrical body of the rotation cover 62. With this configuration, by inserting the tip end portion of the toner bottle 70 in the rotation cover 62, the protruding portion 65 can be engaged with the concave portion 33.

A toner passing port 62*a* is provided on the rotation cover 62 at a position that corresponds to the toner supply port 34 of the toner bottle 70. Thus, by rotating the rotation cover 62 integrally with the toner bottle 70 under the state in which the tip end portion of the toner bottle 70 is inserted in the rotation cover 62, the toner can be supplied from the toner supply port 34 via the toner passing port 62*a*. Further, a supporting member 71 including a spring member is fixed to the end portion of the rotation cover 62. The supporting member 71 can support the toner bottle 70 by being hooked in the vicinity of the tip end portion of the inserted toner bottle 70 so that the toner bottle 70 will not come off.

The tip end portion external cover 63 covers and protects an outer periphery of the rotative rotation cover 62. The tip end portion external cover 63 is open on a lower side and connected to the inside of the buffer tank 40 arranged below the tip end portion external cover 63. Thus, the toner can drop from the toner bottle 70 to the buffer tank 40 when the toner supply port 34 faces downward.

As described above, when attaching the toner bottle 70 to the bottle driving unit 57, the toner bottle 70 is regulated (to be located) at the prescribed rotation phase by the bottle upper surface cover 41 (i.e., the toner bottle 70 is regulated such that the toner supply port 34 faces upward). Accordingly, when attaching the toner bottle 70, a rotation phase of the concave portion 33 arranged on the tip end portion of the toner bottle 70 is also regulated at the prescribed rotation phase.

Accordingly, when attaching the toner bottle 70 to the bottle driving unit 57, the toner bottle 70 cannot be attached unless the protruding portion 65 of the driving force transmitting member 61 is located at a rotation phase that matches the prescribed rotation phase of the concave portion 33. That is, if the concave portion 33 and the protruding portion 65 are displaced from each other when attaching the toner bottle 70 to the bottle driving unit 57, the concave portion 33 and the protruding portion 65 cannot be engaged with each other. As a result, the toner bottle 70 cannot be driven and rotated by the driving force transmitting member 61. As described above, when the concave portion 33 and the protruding portion 65 are not appropriately engaged with each other, the positioning protrusion 35 of the toner bottle 70 does not reach the circular grooves 41*b* and 42*a*. As a result, the toner bottle 70 cannot be rotated.

In the present preferred embodiment, when attaching and removing the toner bottle 70 relative to the bottle driving unit 57, the driving force transmitting member 61 is stopped at the prescribed rotation phase. A specific description will be provided below.

As illustrated in FIG. 5, a phase detection member 66 having a flange 66*a* is fixed to the rotation shaft 60 such that the phase detection member 66 cannot be rotated relatively. A slit 66*b* is formed at an appropriate position of an end portion on an outer peripheral side of the flange 66*a*. On a side of the tip end portion external cover 63, a phase sensor 67 is arranged close to the flange 66*a*. The phase sensor 67 is provided as, for example, a photointerrupter, and can detect the slit 66*b* formed on the flange 66*a*. The phase detection member 66 is rotated integrally with the rotation shaft 60. Therefore, by detecting the slit 66*b*, the phase sensor 67 can detect that the rotation shaft 60 has reached the prescribed rotation phase. The phase sensor 67 is electrically connected with the control unit, and can output a signal indicating a detection result of the slit 66*b* to the control unit.

When performing a maintenance operation such as an operation of attaching or removing the toner bottle 70, the control unit controls the motor to stop the rotation of the driving force transmitting member 61. At this time, the control unit rotates the driving force transmitting member 61 until the phase sensor 67 detects the slit 66*b*, and then controls the motor to stop the rotation when the slit 66*b* is detected. Thus, when attaching the toner bottle 70, the rotation phase of the driving force transmitting member 61 is controlled to be always at the prescribed rotation phase, which corresponds to a position of the slit 66*b*.

The position of the slit 66*b* is set such that the rotation phase of the driving force transmitting member 61 at the time of attaching the toner bottle 70 corresponds to the concave portion 33 being under the state in which the toner supply port 34 faces upward. Thus, the concave portion 33 and the protruding portion 65 can be reliably engaged with each other when the toner bottle 70 is inserted in the bottle containing space.

In other words, by setting the position of the slit 66*b* such that the rotation phase of the protruding portion 65 is displaced from the concave portion 33 of the toner bottle 70 being under the state in which the toner supply port 34 faces upward, the toner bottle 70 can be prevented from being attached to the bottle driving unit 57. That is, by providing different attachment phases of the phase detection member 66, copier-and-facsimile MFPs of a plurality of specifications each having a different compatibility with the toner bottle 70 can be achieved (i.e., by changing the attachment phase of the phase detection member 66 with respect to each MFP, the specification of the MFP may be changed).

Considering the above points, in the present preferred embodiment, an attachment position (attachment phase) of the phase detection member 66 relative to the rotation shaft 60 can be selected at the time of assembly. Thus, the phase of the driving force transmitting member 61 at the time of attaching the toner bottle 70 can be selected, and the incompatibility between the toner bottle 70 and the copier-and-facsimile MFP 75 can be achieved. That is, in addition to the function of transmitting the driving force of the motor to the toner bottle 70, the driving force transmitting member has a function of achieving the incompatibility as an incompatibility member.

A detailed description will be made below with reference to FIGS. 7, 9, and 10. FIGS. 9A-9F illustrate six attachment phases of the phase detection member 66. FIGS. 10A-10F illustrate six stop phases of the driving force transmitting member 61 at the time of attaching and removing the toner bottle 70.

As illustrated in FIG. 7, a shaft inserting hole 66*c* into which the rotation shaft 60 can be inserted is formed in the phase detection member 66. Moreover, pin inserting holes 66*d* are formed in the phase detection member 66 in a direction that is perpendicular or substantially perpendicular to the shaft line of the rotation shaft 60. A pin inserting hole 60*d* is formed in the rotation shaft 60 in a direction that is perpendicular or substantially perpendicular to the shaft line of the rotation shaft 60. Under a state in which the rotation shaft 60 is inserted in the shaft inserting hole 66*c*, by aligning the pin inserting hole 66*d* of the phase detection member 66 and the pin inserting hole 60*d* of the rotation shaft 60, a fixing pin 72 can be inserted into the pin inserting holes 66*d* and 60*d*.

Thus, the phase detection member 66 can be fixed by the fixing pin 72 such that the phase detection member 66 cannot be rotated relative to the rotation shaft 60. Further, by arranging the pin inserting holes 60*d* and 66*d* at appropriate positions in advance, the attachment phase (i.e., the position of the slit 66*b*) of the phase detection member 66 can be appropriately positioned relative to the rotation shaft 60. Meanwhile, since the driving force transmitting member 61 is fixed to the rotation shaft 60 by the D-shaped shaft fixing hole 61*a*, the attachment phase of the driving force transmitting member 61 is fixed in advance relative to the rotation shaft 60. With the above configuration, since the driving force transmitting member 61 and the phase detection member 66 can be positioned in a prescribed positional relationship and then attached to the rotation shaft 60, a stop phase of the protruding portion 65 at which the control unit detects the slit 66*b* and stops the motor can be defined as a prescribed rotation phase.

As illustrated in FIGS. 7 and 9, a plurality of pin inserting holes 66*d* are formed in the phase detection member 66. Thus, when assembling the MFP 75, by selecting one of the plurality of pin inserting holes 66*d* to which the fixing pin 72 is to be inserted, the attachment phase of the phase detection member 66 relative to the rotation shaft 60 can be selected from among a plurality of phases. Accordingly, the plurality of pin inserting holes 66*d* serve as a phase selection portion. In the present preferred embodiment, as illustrated in FIGS. 9A-9F, the plurality of pin inserting holes 66*d* are formed at intervals of 60 degrees. Accordingly, the six attachment phases each having a different phase by 60 degrees can be achieved as illustrated in FIGS. 9A through 9F.

By making it possible to select the attachment phase of the phase detection member 66, a phase displacement of the slit 66*b* relative to the driving force transmitting member 61 can be selected. Accordingly, a stop phase of the driving force transmitting member 61 at the time when the control unit detects the slit 66*b* and stops the motor (i.e., at the time of attaching the toner bottle 70) can be selected from among the six stop phases each having a different phase by 60 degrees as illustrated in FIGS. 10A through 10F.

Thus, by making it possible to select the rotation phase of just one component (i.e., the phase detection member 66) and then attaching such a component, the copier-and-facsimile MFPs 75 of a plurality of specifications (i.e., the copier-and-facsimile MFPs 75 of six specifications in the present preferred embodiment) can be achieved at a low cost.

In the present preferred embodiment, the shape of the protruding portion 65 (and the concave portion 33, which corresponds to the protruding portion 65) preferably is rotationally asymmetric. More specifically, the protruding portion 65 including the two cylindrical protrusions is constructed such that each of the protrusions has a different diameter and a different distance from the center of the driving force transmitting member 61.

Assuming that the two protrusions have the same shape and equal distance from the center, and that the two protrusions are arranged at an interval of 180 degrees in a circumferential direction, the protruding portion 65 defines a two-fold symmetry, i.e., the protruding portion 65 has the same shape when being rotated by 180 degrees. Accordingly, even though the attachment phase can be selected from among the six attachment phases each having a different phase by 60 degrees as illustrated in FIGS. 9A-9F when attaching the phase detection member 66 to the rotation shaft 60, if the protruding portion 65 is two-fold symmetric, only three different specifications can be achieved. Considering this point, by providing the rotationally asymmetric protruding portion 65 as in the present preferred embodiment, when the attachment phase of the phase detection member 66 can be selected from N options, N different specifications can be reliably achieved.

Meanwhile, a rotation phase between the bottle main body 31 and the cap member 32 can be selected on the side of the toner bottle 70. More specifically, not-illustrated protruding portions (more specifically, six protruding portions, for example) arranged at equal intervals are provided at a portion of the bottle main body 31 where the cap member 32 is attached. Moreover, not-illustrated groove portions (more specifically, six groove portions, for example) arranged at equal intervals are provided at a portion of the cap member 32 where the cap member 32 is attached to the bottle main body 31. By engaging the protruding portions and the groove portions with each other, an attachment phase of the cap member 32 relative to the bottle main body 31 can be selected, and then the cap member 32 can be attached (more specifically, the attachment phase can be selected from among six attachment phases arranged at intervals of 60 degrees, for example).

Accordingly, the toner bottles 70 of six different specifications respectively corresponding to the six different specifications achievable on the side of the copier-and-facsimile MFPs 75 can be achieved by the cap member 32, which is a common component. Thus, the toner bottles 70 can be supplied at a low cost. If the bottle main body 31 and the cap member 32 can be detached, the incompatibility is lost. Therefore, when attaching the cap member 32 to the bottle main body 31, the cap member 32 is non-removably fixed by a proper method such as adhesion or bonding, for example.

The toner passing port 62*a* provided on the rotation cover 62 cannot pass the toner of the toner bottle 70 unless the toner passing port 62*a* is located at a position that matches the toner supply port 34 of the toner bottle 70. When attaching the toner bottle 70, the tip end portion of the toner bottle 70 is inserted into the rotation cover 62 under the state in which the toner supply port 34 faces upward. Therefore, when attaching the toner bottle 70, the rotation cover 62 needs to be stopped under the state in which the toner passing port 62*a* faces upward.

In the present preferred embodiment, the rotation cover 62 is attached such that the rotation cover 62 cannot be rotated relative to the driving force transmitting member 61 but can be rotated integrally with the driving force transmitting member 61. If an attachment phase of the rotation cover 62 relative to the driving force transmitting member 61 is limited to only one phase (i.e., if the attachment phase of the rotation cover 62 cannot be selected), the toner passing hole 62*a* of the rotation cover 62 may stop in directions other than an upward-facing direction because of the plurality of specifications each having a different stop phase of the driving force transmitting member 61 at the time of attaching the toner bottle 70.

Figure 11:
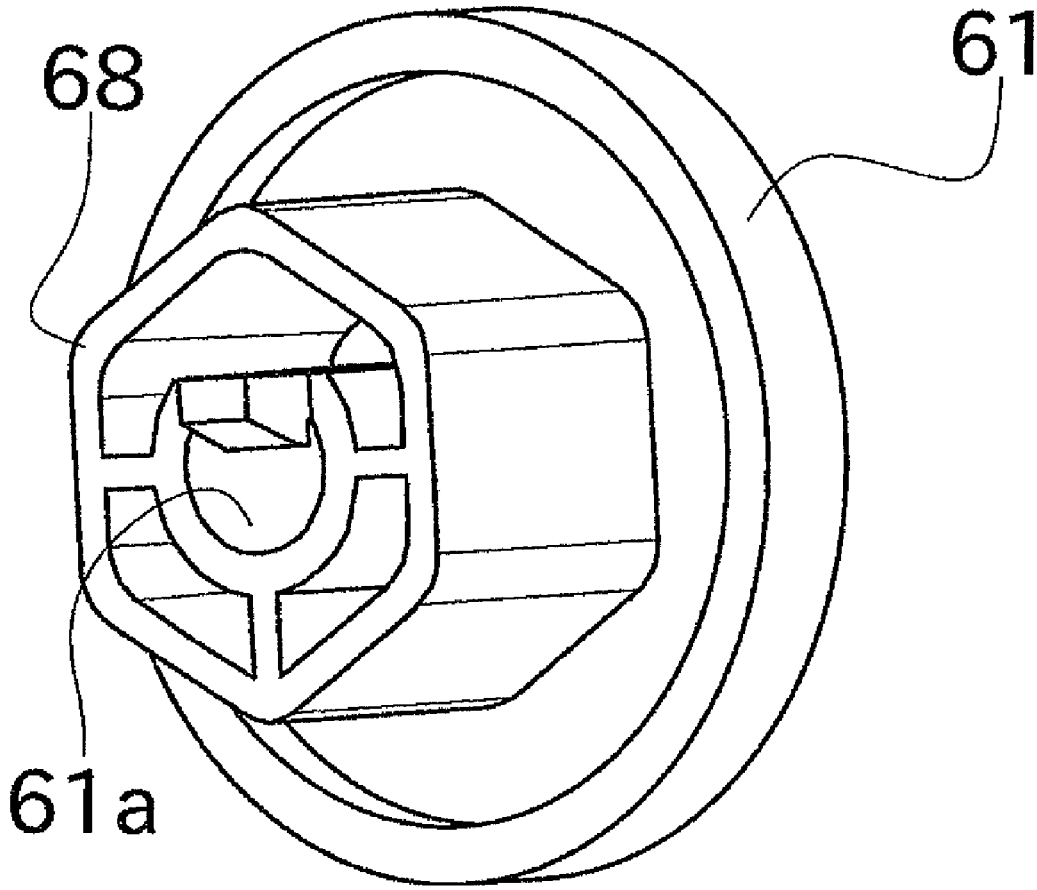
FIG. 11 is an external perspective view of the driving force transmitting member.
Figure 12:
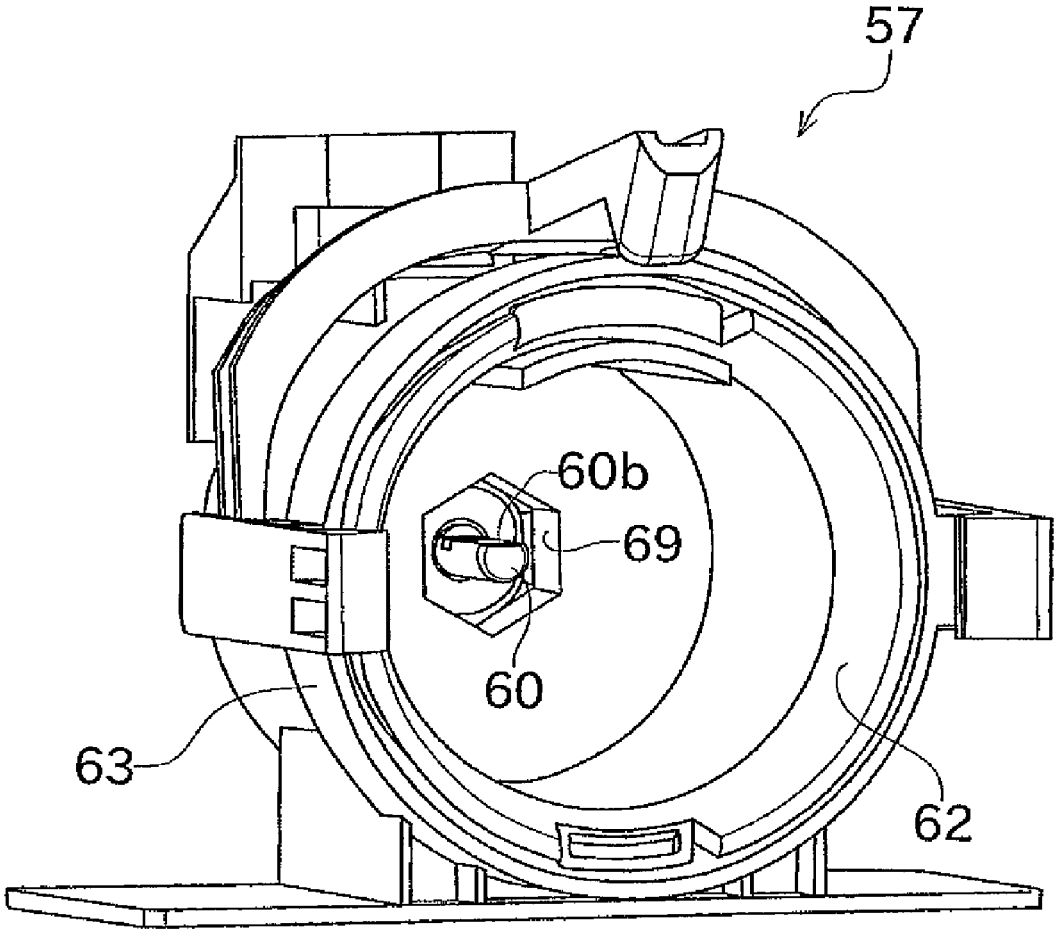
FIG. 12 is an external perspective view of the bottle driving unit in which the driving force transmitting member is removed from the rotation cover.

In the present preferred embodiment, the attachment phase of the rotation cover 62 relative to the driving force transmitting member 61 can be selected at the time of assembling. A specific description will be made below with reference to FIGS. 11 and 12. FIG. 11 is an external perspective view of the driving force transmitting member. FIG. 12 is an external perspective view of the bottle driving unit in which the driving force transmitting member 61 is removed from the rotation cover 62.

As illustrated in FIG. 11, in the disc-shaped driving force transmitting member 61, an engagement protrusion 68 is provided on a side opposite from the side on which the protruding portion 65 is formed. The engagement protrusion 68 protrudes in the direction of the rotation shaft 60 and is rotationally symmetric when viewed in the shaft line direction of the rotation shaft 60 (more specifically, the engagement protrusion 68 has a regular hexagon shape). As illustrated in FIG. 12, an engagement hole (attaching portion) 69 is formed at a position that corresponds to a rotation center of the rotation cover 62 and to the attachment position of the driving force transmitting member 61. The engagement hole 69 is rotationally symmetric corresponding to the engagement protrusion 68 (more specifically, the engagement hole 69 has a regular hexagon shape with an outline that substantially matches that of the engagement protrusion 68). By engaging the engagement protrusion 68 with the engagement hole 69, the driving force transmitting member 61 can be attached to the rotation cover 62.

As described above, since each of the engagement protrusion and the engagement hole 69 is rotationally symmetric, the attachment position of the driving force transmitting member 61 (i.e., the attachment phase of the driving force transmitting member 61 relative to the rotation cover 62) can be selected at the time of assembling the machine. More specifically, since each of the engagement protrusion 68 and the engagement hole 69 has a regular hexagon shape, six different attachment phases can be achieved by changing the phase by 60 degrees, for example. Accordingly, in accordance with the six stop phases of the driving force transmitting member 61 at the time of attaching the toner bottle 70, the driving force transmitting member 61 can be attached to the rotation cover 62 such that the toner passing hole 62*a* faces upward when attaching the toner bottle 70.

By providing the multi-angular (not round) engagement protrusion 68 and engagement hole 69, the driving force of the driving force transmitting member 61 can be appropriately transmitted to the rotation cover 62, and the rotation cover 62 can be driven and rotated integrally with the toner bottle 70.

A process of assembling the bottle driving unit 57 with the above configuration will be simply described with reference to FIG. 7.

Basically, a specification of incompatibility is not changed after the assembling. Therefore, before the assembling, the attachment phase of the phase detection member 66 is determined to be one of the six phases illustrated in FIGS. 9A-9F.

First, the driving force transmitting member 61 is attached to the driving force transmitting member attaching portion 60*b* of the rotation shaft 60. Then, the engagement protrusion 68 of the driving force transmitting member 61 is engaged with the engagement hole 69 of the rotation cover 62 from the inside of the cup-shaped rotation cover 62. At this time, in accordance with the specification of the incompatibility, the phase is selected so that the toner passing hole 62*a* faces upward when attaching the toner bottle 70. Thus, the rotation shaft 60 attached to the driving force transmitting member 61 protrudes from the engagement hole 69 towards the outside of the rotation cover 62 as illustrated in FIG. 5.

Then, the protruding rotation shaft 60 is inserted from the inside of the tip end portion external cover 63 to a shaft inserting hole 63*a* provided on the tip end portion external cover 63. Thus, while the rotation shaft 60 protrudes from the shaft inserting hole 63*a* towards the outside of the tip end portion external cover 63, the rotation cover 62 is placed inside the tip end portion external cover 63.

Then, the rotation shaft 60 protruding towards the outside of the tip end portion external cover 63 is inserted into the shaft inserting hole 66*c* of the phase detection member 66. After positioning the rotation phase of the slit 66*b* relative to the rotation shaft 60 at a prescribed position, the fixing pin 72 is inserted into the pin inserting holes 60*d* and 66*d*. Lastly, the gear attaching portion 60*a* of the rotation shaft 60 is inserted into and fixed at the shaft fixing hole 64*a* of the gear 64, and thus, the assembling of the bottle driving unit 57 is completed.

As described above, the copier-and-facsimile MFP 75 according to the present preferred embodiment includes the rotation shaft 60, the driving force transmitting member 61, the phase detection member 66, the not-illustrated control unit, and the bottle upper surface cover 41. The rotation shaft 60 is rotated by the motor. The driving force transmitting member 61 is attached such that the driving force transmitting member 61 cannot be rotated relative to the rotation shaft 60. The toner bottle 70 can be removably attached to the driving force transmitting member 61. The phase detection member 66 is attached such that the phase detection member 66 cannot be rotated relative to the rotation shaft 60. The control unit controls the motor such that the rotation phase of the phase detection member 66 is stopped at the prescribed phase at least when the toner bottle 70 and the driving force transmitting member 61 are attached and removed. The bottle upper surface cover 41 regulates the toner bottle 70 such that the rotation phase of the toner bottle 70 is located at the prescribed phase when the toner bottle 70 and the driving force transmitting member 61 are attached and removed. The driving force transmitting member 61 includes the protruding portion 65 that can transmit the rotation driving force of the rotation shaft 60 to the toner bottle 70 by being connected to the concave portion 33 of the toner bottle 70 such that the protruding portion 65 cannot be rotated relative to the concave portion 33. The phase detection member 66 includes the pin inserting holes 66*d* that allow to select the rotation phase when being attached to the rotation shaft 60.

Thus, just by selecting the rotation phase of the phase detection member 66 relative to the rotation shaft 60, the copier-and-facsimile MFPs 75 of a plurality of specifications each having a different rotation phase of the protruding portion 65 at the time of attaching and removing the driving force transmitting member 61 and the toner bottle 70 can be achieved. When attaching and removing the protruding portion 65 and the concave portion 33, regardless of the specification of the copier-and-facsimile MFP 75, the toner bottle 70 is regulated by the bottle upper surface cover 41 such that the phase of the concave portion 33 is located at the prescribed phase. Thus, the incompatibility that permits only a specific toner bottle 70 to be attached with respect to each of the specifications and that prevents other toner bottles from being attached can be achieved by the components (i.e., the driving force transmitting member 61, the rotation shaft 60, and the phase detection member 66) that are common to each of the specifications. Accordingly, the copier-and-facsimile MFP 75 that achieves the incompatibility can be provided at a low cost.

The copier-and-facsimile MFP 75 according to the present preferred embodiment includes the following configuration. That is, the toner bottle 70 includes the bottle main body 31 and the cap member 32. The cap member 32 can change its rotation phase when being attached to the bottle main body 31. The concave portion 33 is arranged on the cap member 32.

Thus, by changing the attachment phase of the common components (i.e., the cap member 32 and the bottle main body 31), the toner bottle 70 of different specifications can be achieved. Accordingly, by sharing the same components, the incompatibility of the toner bottle 70 can be achieved at a low cost.

In the copier-and-facsimile MFP 75 according to the present preferred embodiment, the protruding portion 65 includes a plurality of protrusions protruding in the shaft line direction of the rotation shaft 60, and the concave portion 33 has a shape that corresponds to the plurality of protrusions.

Since the plurality of protrusions are provided, the rotation driving force can be transmitted from the driving force transmitting member 61 to the toner bottle 70 more stably as compared to only one protrusion.

In the copier-and-facsimile MFP 75 according to the present preferred embodiment, the protruding portion 65 and the concave portion 33 preferably are rotationally asymmetric viewed in the shaft line direction of the rotation shaft 60.

If the protruding portion 65 and the concave portion 33 are rotationally symmetric, the protruding portion 65 and the concave portion 33 may be connected with each other a plurality of times in a relative phase of 360 degrees. Therefore, even if there are N selectable rotation phases ("N" is the number of the rotation phases) when attaching the phase detection member 66 to the rotation shaft 60, the number of achievable specifications may be less than "N". Considering this point, by arranging the protruding portion 65 and the concave portion 33 to be rotationally asymmetric, in the case where there are N selectable rotation phases when attaching the phase detection member 66 to the rotation shaft 60, N different specifications can be reliably achieved.

In the copier-and-facsimile MFP 75 according to the present preferred embodiment, at least one of the plurality of protrusions preferably has a shape that is different from those of the other protrusions.

By providing at least one of the plurality of protrusions with the shape that is different from those of the other protrusions, in the case where there are N selectable rotation phases when attaching the phase detection member 66 (or the driving force transmitting member 61) to the rotation shaft 60, the N different specifications can be reliably achieved.

In the copier-and-facsimile MFP 75 according to the present preferred embodiment, at least one of the plurality of protrusions preferably has a distance that is different from a distance of each of the other protrusions relative to the rotation shaft 60.

Accordingly, by just arranging at least one of the plurality of protrusions at the distance different from the distance of each of the other protrusions relative to the rotation shaft 60, in the case where there are N selectable rotation phases when attaching the phase detection member 66 (or the driving force transmitting member 61) to the rotation shaft 60, the N different specifications can be reliably achieved.

The copier-and-facsimile MFP 75 according to the present preferred embodiment preferably includes the developing roller 29, the developer container 26 that supplies toner to the developing roller 29, and the buffer tank 40 that temporarily accumulates the toner between the toner bottle 70 and the developer container 26.

Accordingly, since a certain amount of toner is accumulated in the buffer tank 40, even if the toner bottle 70 runs out of toner, it takes a certain period of time until the developer container 26 becomes empty. Therefore, even if the toner bottle 70 is empty, the toner bottle 70 can be replaced with a certain degree of time to spare.

In the copier-and-facsimile MFP 75 according to the present preferred embodiment, the pin inserting hole 66*d* preferably includes a plurality of holes arranged in the circumferential direction. The rotation shaft 60 includes the pin inserting hole 60*d* to which the fixing pin 72 is inserted. When the fixing pin 72 is inserted into the hole selected from the pin inserting hole 66*d* and into the pin inserting hole 60*d*, the phase detection member 66 or the driving force transmitting member 61 is attached to the rotation shaft 60.

Thus, by inserting the fixing pin 72 into the hole selected from the pin inserting hole 66*d* and into the pin inserting hole 60*d*, the phase detection member 66 or the driving force transmitting member 61 can be reliably attached to the rotation shaft 60. Further, since the pin inserting hole 66*d* also serves as an attaching hole, with this simple configuration, the phase detection member 66 or the driving force transmitting member 61 can be attached such that the rotation phase with respect to the rotation shaft 60 can be selected.

The copier-and-facsimile MFP 75 according to the present preferred embodiment further includes the toner supplying unit 55 in which the substantially cylindrical bottle containing space is formed. The toner bottle 70 is attached to the driving force transmitting member 61 inside the bottle containing space, and includes the positioning protrusion 35 that protrudes in the circumferential direction. The positioning groove 41*a* that corresponds to the positioning protrusion 35 is formed on the inner peripheral surface of the toner supplying unit 55 along the direction in which the toner bottle 70 is inserted into the bottle containing space.

Thus, with the simple configuration, the attachment of the toner bottle 70 to the driving force transmitting member 61 can be regulated only at the prescribed phase.

In the copier-and-facsimile MFP 75 according to the present preferred embodiment, the circular grooves 41*b* and 42*a* connected to the positioning groove 41*a* are preferably provided on the inner peripheral surface of the toner supplying unit 55 around the entire circumference in an inner peripheral direction of the toner supplying unit 55. When the toner bottle 70 is driven and rotated, the positioning protrusion 35 rotates along the circular grooves 41*b* and 42*a*.

Thus, at the position where the toner bottle 70 is attached to the driving force transmitting member 61, the toner bottle 70 goes back to the rotatable state in order to supply the toner.

In the copier-and-facsimile MFP 75 according to the present preferred embodiment, only when the protruding portion 65 and the concave portion 33 are connected with each other, the positioning protrusion 35 can be fitted to the circular grooves 41*b* and 42*a*.

Thus, only when the protruding portion 65 and the concave portion 33 are connected with each other, the toner bottle 70 can be rotated, and when the attachment of the toner bottle 70 is insufficient, the toner bottle 70 can be prevented from being mistakenly rotated.

The toner bottle 70 according to the present preferred embodiment includes the bottle main body 31, the concave portion 33 arranged to receive the rotation driving force around the central shaft line of the bottle main body 31, and the cap member 32 that can change its rotation phase at which the cap member 32 is attached to the bottle main body 31.

Accordingly, by changing the attachment phase of the common components (cap member 32 and the bottle main body 31), the toner bottles 70 of different specifications can be achieved. Accordingly, by sharing the same components, the toner bottles 70 that achieve the incompatibility can be provided at a low cost.

In the toner bottle 70 according to the present preferred embodiment, a spiral protrusion is provided inside the bottle main body 31, and the toner supply port 34 connected to the inside of the toner bottle 70 is provided on the cap member 32.

Thus, when the toner bottle 70 is rotated in one direction, all the toner is moved towards the toner supply port 34. Therefore, when supplying the toner, all the toner can be supplied to a toner receiving container such as the buffer tank 40 or the like.

According to the present preferred embodiment, the toner bottle 70 is preferably attached to the bottle driving unit 57 in the central shaft line direction of the bottle main body 31. The positioning protrusion 35 protruding in the circumferential direction is formed on the outer peripheral surface of the toner bottle 70. The positioning groove 41*a* is formed on the bottle driving unit 57 in the direction in which the toner bottle 70 is inserted. The positioning protrusion 35 can be fitted to the positioning groove 41*a*.

Thus, when attaching the toner bottle 70, the toner bottle 70 cannot be rotated around the attachment direction but can be attached at the prescribed phase. Therefore, while maintaining the attachment phase of the cap member 32 and the bottle main body 31, the toner bottle 70 can be attached.

Preferred embodiments of the present invention have been described above, however, the above configuration can be modified as follows, for example.

In the above-described preferred embodiments, the attachment phase of the driving force transmitting member 61 relative to the rotation shaft 60 cannot be selected, and the attachment phase of the phase detection member 66 relative to the rotation shaft 60 can be selected. Instead, the attachment phase of the phase detection member 66 relative to the rotation shaft 60 may not be selected, and the attachment phase of the driving force transmitting member 61 relative to the rotation shaft 60 may be selected.

Similar advantages to the above preferred embodiments may be achieved by providing a phase selection portion on the rotation shaft 60. For example, by providing a plurality of pin inserting holes at intervals of 60 degrees around the entire circumference of the rotation shaft 60, six different specifications may be achieved similarly to the above preferred embodiments, for example.

The interval at which the plurality of pin inserting holes 66*d* are formed is not limited to 60 degrees. For example, by providing the plurality of pin inserting holes 66*d* at intervals of 45 degrees, eight different specifications may be achieved, for example. Further, the present invention is not limited to the configuration in which the attachment phase can be selected by using the fixing pin 72 and the pin inserting holes 66*d* and 60*d*. For example, another configuration may be adopted in which the attachment phase relative to the rotation shaft 60 can be selected.

In the above preferred embodiment, the concave portion 33 is preferably provided on the toner bottle 70, and the protruding portion 65 is preferably provided on the driving force transmitting member 61, however, the present invention is not limited to such a configuration as long as the rotation driving force can be transmitted to the toner bottle 70, and the toner bottle 70 can be removably attached. For example, the protruding portion may be provided on the toner bottle 70, and the concave portion may be provided on the driving force transmitting member. Alternatively, for example, both the protruding portion and the concave portion may be formed on the driving force transmitting member 61.

In the above preferred embodiment, the regular-hexagonal engagement protrusion 68 is preferably provided on the driving force transmitting member 61, and the regular-hexagonal engagement hole 69 is formed in the rotation cover 62, however, the present invention is not limited to such a configuration as long as the engagement protrusion 68 and the engagement hole 69 are rotationally symmetric, and as long as they can be connected in such a manner that they cannot be rotated relative to each other. Moreover, since the eight different specifications can be achieved by providing the pin inserting holes at intervals of 45 degrees as described above, in this case, for example, regular-octagonal engagement protrusion and engagement hole may be formed in accordance with the eight stop phases of the driving force transmitting member 61.

In the above preferred embodiments, the protruding portion 65 preferably includes the two cylindrical protrusions, however, the protruding portion 65 may include one or at least three protrusions, for example. Further, the shape of the protrusion is not limited to the cylindrical shape, but may be, for example, a plate-like shape. However, it is preferable to provide a shape having rigidity that can reliably transmit the rotation driving force to the toner bottle.

In the above preferred embodiments, the positioning protrusion 35 is preferably provided on the toner bottle 70, and the positioning groove 41*a* is preferably provided on the bottle upper surface cover 41, however, the present invention is not limited to such a configuration as long as the rotation phase can be regulated when inserting the toner bottle 70. For example, a groove may be provided on the toner bottle 70, and a protrusion may be provided on the bottle upper surface cover 41.

The copier-and-facsimile MFP 75 may be an image forming apparatus (for example, an image forming apparatus including four toner bottles of Cyan, Magenta, Yellow, and Black) including a plurality of toner bottles (not a single toner bottle). In such a case, a plurality of bottle driving units need to be provided, and the toner bottles of each color need to be inserted into the respective bottle driving units, which thereby can frequently generate attachment errors. In such a configuration, the attachment errors can be prevented by providing the toner bottle with the incompatibility as with various preferred embodiments of the present invention.

The configuration of various preferred embodiments of the present invention may be applied to not only the copier-and-facsimile MFP 75 but also an image forming apparatus having another configuration such as, for example, a copier and a facsimile machine.

While the present invention has been described with respect to preferred embodiments thereof, it will be apparent to those skilled in the art that the disclosed invention may be modified in numerous ways and may assume many preferred embodiments other than those specifically set out and described above. Accordingly, the appended claims are intended to cover all modifications of the present invention that fall within the true spirit and scope of the present invention.

What is claimed is:

1. An image forming apparatus comprising:

a rotation shaft arranged to be rotated by a rotation driving unit;

a drive transmitting member arranged to:

be attached to the rotation shaft such that the drive transmitting member cannot be rotated relative to the rotation shaft;

removably attach a toner bottle thereto; and include a bottle connection portion arranged to transmit a rotation driving force of the rotation shaft to the toner bottle by being connected with a connected portion of the toner bottle such that the bottle connection portion cannot be rotated relative to the connected portion of the toner bottle;

a phase detection member attached to the rotation shaft such that the phase detection member cannot be rotated relative to the rotation shaft;

a control unit arranged to control the rotation driving unit such that a rotation phase of the phase detection member stops at a prescribed phase at least when attaching the toner bottle to the drive transmitting member and removing the toner bottle from the drive transmitting member;

a regulation member arranged to regulate the toner bottle such that a rotation phase of the toner bottle is a prescribed phase when attaching the toner bottle to the drive transmitting member and removing the toner bottle from the drive transmitting member; and a phase selection portion provided on at least any one of the rotation shaft, the phase detection member, and the drive transmitting member, the phase selection portion being arranged to select a rotation phase of the phase selection portion and then be attached after the selection when attaching the phase detection member or the drive transmitting member to the rotation shaft.

2. The image forming apparatus according to claim 1, wherein the toner bottle includes:

a bottle main body; and a cap member arranged to change a rotation phase of the cap member when the cap member is attached to the bottle main body; and the connected portion of the toner bottle is provided on the cap member.

3. The image forming apparatus according to claim 1, wherein one of the bottle connection portion and the connected portion includes a plurality of protrusions protruding in a shaft line direction of the rotation shaft, and the other one of the bottle connection portion and the connected portion includes a plurality of concave portions that correspond to the plurality of protrusions.

4. The image forming apparatus according to claim 3, wherein the bottle connection portion and the connected portion are rotationally asymmetric as viewed from the shaft line direction of the rotation shaft.

5. The image forming apparatus according to claim 4, wherein at least one of the plurality of protrusions includes a shape that is different from shapes of the other protrusions.

6. The image forming apparatus according to claim 4, wherein at least one of the plurality of protrusions includes a distance that is different from distances of the other protrusions relative to the rotation shaft.

7. The image forming apparatus according to claim 1, wherein the bottle connection portion and the connected portion are rotationally asymmetric as viewed from a shaft line direction of the rotation shaft.

8. The image forming apparatus according to claim 1, further comprising:

a developing roller;

a toner container arranged to supply toner to the developing roller; and a buffer tank arranged to temporarily accumulate the toner between the toner bottle and the toner container.

9. The image forming apparatus according to claim 1, wherein the phase selection portion includes a plurality of holes arranged in a circumferential direction, the rotation shaft includes an inserting hole to which a pin is inserted, and when the pin is inserted into a hole selected from the plurality of holes and into the inserting hole, the phase detection member or the drive transmitting member is attached to the rotation shaft.

10. The image forming apparatus according to claim 1, further comprising a toner supplying unit in which a substantially cylindrical bottle containing space is provided; wherein the rotation shaft and the drive transmitting member are arranged inside the bottle containing space, the toner bottle is attached to the drive transmitting member inside the bottle containing space, the toner bottle includes a positioning protrusion protruding in a circumferential direction, and a positioning groove corresponding to the positioning protrusion is provided on an inner peripheral surface of the toner supplying unit along a direction in which the toner bottle is inserted into the bottle containing space.

11. The image forming apparatus according to claim 10, wherein a circular groove connected to the positioning groove is provided on the inner peripheral surface of the toner supplying unit around an entire circumference in an inner peripheral direction of the toner supplying unit, and when the toner bottle is driven and rotated, the positioning protrusion is rotated along the circular groove.

12. The image forming apparatus according to claim 11, wherein the positioning protrusion fits to the circular groove only when the bottle connection portion and the connected portion are connected with each other.

* * * * *